US005912212A

United States Patent [19]

Igarashi et al.

[11] Patent Number: 5,912,212

[45] Date of Patent: Jun. 15, 1999

[54] LUBRICATING OIL COMPOSITION

[75] Inventors: Jinichi Igarashi; Yoko Matsuyama; Yutaka Shikatani; Toshio Yoshida, all of Yokohama, Japan

[73] Assignee: Nippon Oil Co., Ltd., Tokyo, Japan

[21] Appl. No.: 08/769,244

[22] Filed: Dec. 18, 1996

[30] Foreign Application Priority Data

| | | | |
|---|---|---|---|
| Dec. 28, 1995 | [JP] | Japan | 7-353638 |
| Dec. 28, 1995 | [JP] | Japan | 7-353639 |
| Jan. 16, 1996 | [JP] | Japan | 8-023114 |
| Jan. 16, 1996 | [JP] | Japan | 8-023115 |

[51] Int. Cl.[6] ..... C10M 129/70; C10M 141/06; C10M 141/10

[52] U.S. Cl. ..... 508/275; 508/273; 508/276; 508/424; 508/444; 508/465; 508/501; 508/503

[58] Field of Search ..... 508/335, 363, 508/273, 275, 503, 501, 276, 465, 424, 444

[56] References Cited

U.S. PATENT DOCUMENTS

| | | | |
|---|---|---|---|
| 2,443,263 | 6/1948 | Mikeska . | |
| 2,443,264 | 6/1948 | Mikeska . | |
| 3,247,240 | 4/1966 | Meier et al. . | |
| 3,330,859 | 7/1967 | Dexter et al. . | |
| 3,441,575 | 4/1969 | Dexter et al. . | |
| 3,494,887 | 2/1970 | Dexter et al. . | |
| 3,497,549 | 2/1970 | Dexter et al. . | |
| 3,644,482 | 2/1972 | Dexter et al. . | |
| 3,779,945 | 12/1973 | Dexter et al. . | |
| 3,801,540 | 4/1974 | Dexter et al. . | |
| 4,594,444 | 6/1986 | Orban | 560/67 |
| 4,701,273 | 10/1987 | Brady et al. . | |
| 4,880,551 | 11/1989 | Doe . | |
| 5,167,844 | 12/1992 | Schumacher et al. . | |
| 5,354,486 | 10/1994 | Evans . | |
| 5,658,865 | 8/1997 | Yoshida et al. | 508/501 |
| 5,658,866 | 8/1997 | Yoshida et al. | 508/503 |

FOREIGN PATENT DOCUMENTS

| | | |
|---|---|---|
| 0 148 729 A2 | 7/1985 | European Pat. Off. . |
| 0 366 040 A1 | 5/1990 | European Pat. Off. . |
| 0 432 089 A1 | 6/1991 | European Pat. Off. . |
| 0 716 141 A2 | 6/1996 | European Pat. Off. . |
| 0 716 141 A3 | 6/1996 | European Pat. Off. . |
| 0 716 142 A2 | 6/1996 | European Pat. Off. . |
| 0 716 142 A3 | 6/1996 | European Pat. Off. . |
| 5-179 275 | 7/1993 | Japan . |
| 996502 | 6/1965 | United Kingdom . |
| 2 152 073 | 7/1985 | United Kingdom . |

*Primary Examiner*—Margaret Medley
*Attorney, Agent, or Firm*—Panitch Schwarze Jacobs & Nadel, P.C.

[57] ABSTRACT

A lubricating oil composition comprises (A) a base oil, (B) a 3-methyl-5-tert-butyl-4-hydroxyphenyl substituted fatty acid ester in an amount of 0.1–5 percent by mass and (C) an auxiliary component, said auxiliary component being one member of the group of (a) a nitrogen-containing compound in an amount of 0.001–1 percent by mass, (b) a sulfur and/or phosphorus-containing compound in an amount of 0.1–5.0 percent by mass or (c) a phenolic compound in an amount of 0.1–5.0 percent by mass. This composition features the combination with a base oil of these specified components whereby there is provided synergistic effect conducive to inhibition or prevention of both oxidation and sludge formation while in use under elevated temperature conditions over extended periods of time.

19 Claims, No Drawings

LUBRICATING OIL COMPOSITION

BACKGROUND OF THE INVENTION

1. Field of the Invention

This invention relates generally to lubricating oil compositions and specifically to such an oil composition which has high oxidative stability at elevated temperatures.

2. Prior Art

It is widely accepted that a 2,6-di-tert-butyl-p-cresol, a compound known as DBPC, is highly effective as an oxidation inhibitor for lubricating oils such as typically turbine oil. However, DBPC per se of a relatively low molecular weight is susceptible to a reduction in its concentration by evaporation upon exposure to elevated temperature over prolonged length of time, resulting in a loss of oxidative stability.

Japanese Laid-Open Patent Publication No. 60-156644 discloses the use of sterically hindered hydroxyphenylcarboxylic acid ester as a stabilizing agent for synthetic organic polymers, animal and vegetable oils, hydrocarbons, lubricants and the like. A specific example of this stabilizing agent is disclosed to be (3,5-di-tert-butyl-4-hydroxyphenyl) propionic acid ester. While this compound is much more resistant to diminution by evaporation compared to 2,6-di-tert-butyl-p-cresol, it is less effective in terms of oxidation-inhibition.

A demand is acknowledgeable for high oxidation resistant lubricants capable of use in gas turbines, compressors, hydraulically actuated machines and the like operative at extremely high temperatures that have become increasingly compact in size and longer in service life.

As a result of extensive research and development directed to the discovery of oxidation-resistant lubricant compositions comparable or even superior to the conventional 2,6-di-tert-butyl-p-cresol, the present inventors have found that a surprisingly effective lubricant composition can be provided by the use of a predetermined amount of a 3-methyl-5-tert-butyl-4-hydroxyphenyl substituted fatty acid ester as an additive to a highly refined base oil such as hydrocracked oil or certain synthetic oils, as disclosed in Japanese Patent Application No. 6-330532.

It has later been found however that the additive of 3-methyl-5-tert-butyl-4-hydroxyphenyl substituted fatty acid ester as used in a base oil sufficiently or not sufficiently refined fails to exhibit particularly effective oxidation inhibiting capability over phenol-based oxidation inhibitors including 2,6-di-tert-butyl-p-cresol when applied under relatively mild temperature, oxygen pressure and prolonged oxidative environment.

It has now been found that the use of an auxiliary component which is one member of the group consisting of a specific nitrogen-containing compound, a specific sulfur and/or phosphorus-containing compound and a specific phenolic compound as combined in a predetermined proportion with 3-methyl-5-tert-butyl-4-hydroxyphenyl substituted fatty acid ester is highly conducive to the availability of an improved lubricating oil composition which is capable of sustained oxidative stability under severe operating conditions over extended periods of time.

It has also been found that the use of an auxiliary component consisting essentially of the nitrogen-containing compound and the sulfur and/or phosphorus compound leads to further improvement in oxidative stability.

According to the invention, there is provided a lubricating oil which comprises (A) a base oil, (B) a 3-methyl-5-tert-butyl-4-hydroxyphenyl substituted fatty acid ester in an amount of 0.1–5 percent by mass represented by the formula

I

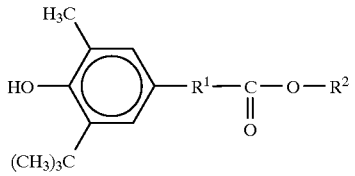

wherein $R^1$ is an alkylene group of 1–6 carbon atoms and $R^2$ is an alkyl or alkylene group of 1–24 carbon atoms, and (C) an auxiliary component, said auxiliary component being one member of the group of:

(a) a nitrogen-containing compound in an amount of 0.001–1 percent by mass, said nitrogen-containing compound being selected from the group consisting of thiadiazole, benzotriazole and/or the derivative thereof and benzothiazole;

(b) a sulfur and/or phosphorus-containing compound in an amount of 0.1–5.0 percent by mass, said sulfur and/or phosphorus-containing compound being selected from the group consisting of sulfides, phosphides, dithiophosphates and dithiocarbamates; or (c) a phenolic compound in an amount of 0.1–5.0 percent by mass, said phenolic compound being selected from the group consisting of a compound (c-1) of the formula

XVI

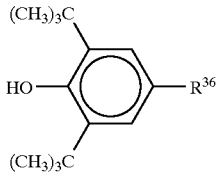

wherein $R^{36}$ is an alkyl group of 1–4 carbon atoms, a group of the formula (i)

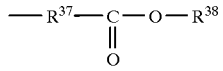

wherein $R^{37}$ is an alkylene group of 1–6 carbon atoms and $R^{38}$ is an alkylene or an alkyl group of 1–24 carbon atoms, or a group of the formula (ii)

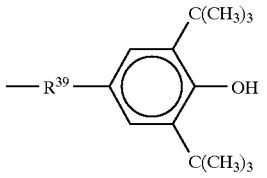

wherein $R^{39}$ is an alkylene group of 1–6 carbon atoms, and a compound (c-2) of the formula

XVII

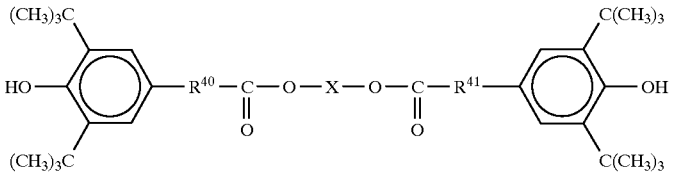

wherein $R^{40}$ and $R^{41}$ each are an alkylene group of 1–6 carbon atoms and X is an alkylene group of 1–18 carbon atoms or a group of the formula $$—R^{42}—S—R^{43}— \quad \text{(iii)}$$

wherein $R^{42}$ and $R^{43}$ each are an alkylene group of 1–6 carbon atoms, the foregoing percentages by mass being based on total composition.

According to a preferred embodiment of the invention, the auxiliary compound consists essentially of the nitrogen-containing compound and the sulfur and/or phosphorus compound.

DETAILED DESCRIPTION OF THE INVENTION

The term base oil as used herein designates both mineral and synthetic oils.

Suitable mineral oils may be atmospheric or vacuum distillates which are subjected to solvent deasphalting, solvent extraction, hydrocracking, solvent dewaxing, catalytic dewaxing, hydrodewaxing, hydrorefining, sulfuric acid treatment, clay treatment and the like. Two or more of these refining processes may be combined to produce paraffinic or naphthenic mineral oils for use as the base oil in the invention.

Synthetic lubricant base oils eligible for the purpose of the invention include polyalpha-olefin such as polybutene, 1-octene oligomer, 1-decene oligomer and the like, alkylbenzene, alkyl naphthalene, diester such as ditridecyl glutarate, di-2-ethylhexyl adipate, diisodecyl adipate, ditridecyl adipate, di-2-ethylhexylsebacate and the like, polyester such as trimellitic acid ester, polyol ester such as trimetylolpropane caprylate, trimethylolpropane pelargonate, pentaerythritol-2-ethyl hexanoate, pentaerythritol pelargonate and the like, polyoxyalkylene glycol, dialkyldiphenyl ether, polyphenyl ether and the like. These base oils may be used singly or in combination.

The base oils referred to herein have viscosities at 40° C. in the range of 1–1,000 $mm^2/s$, preferably 5–800 $mm^2/s$, although there is no particular restriction for the purpose of the invention.

However, the base oil should be selected from the group consisting of the components A-1 through A-3 because its combination with a 3-methyl-5-tert-butyl-4-hydroxyphenyl-substituted fatty ester (Component B) is highly conducive to inhibition or prevention of both oxidation and sludge formation.

(A-1) a mineral oil having a kinematic viscosity of 5–200 $mm^2/s$ at 40° C. and an aromatics content of less than 15 percent by mass.

(A-2) an olefinic polymer of 2–16 carbon atoms or its hydrogenated product having a number-average molecular weight of 250–4,000.

(A-3) an alkylbenzene having 1–4 alkyl groups of 1–40 carbon atoms and a total carbon number of said alkyl groups in the range of 6–40.

The component (A-1) is a mineral oil having a kinematic viscosity of 5–200, preferably 10–100 $mm^2/s$ at 40° C. and an aromatics content of less than 15 percent by mass. Kinematic viscosities lower than 5 $mm^2/s$ would fail in lubricity due to deficient oil film formation, with increased evaporation losses when exposed to high temperature environment. With higher viscosities than 200 $mm^2/s$, the resulting oil composition would have increased flow resistance and hence increased friction resistance at the site of lubrication. The aromatics content of the component (A-1) is preferably smaller than 10, more preferably smaller than 7 percent by mass. Aromatics content exceeding 15 percent by mass would fail to achieve the intended synergistic effect with Component (B) upon prevention of oxidation and sludge formation. The minimum aromatics content is 2 percent by mass or greater in order to ensure dissolution of sludge in the resultant lubricant composition.

The term aromatics content as used herein designates the content of aromatics fractions measured in accordance with ASTM D2549 (Standard Test Method for Separation of Representative Aromatics and Nonaromatics Fractions of High-Boiling Oils by Elution Chromatography). The aromatics fractions usually include alkylbenzene, alkylnaphthalene, anthracene, phenanthrene and alkylates thereof, tetra- or greater cyclic benzene condensates, and heteroaromatics such as pyridines, quinolines, phenols and naphthols.

The component (A-1) may be made available from (1) atmospheric distillation of paraffinic-base and/or mixed-base crude oil; (2) vacuum distillation (WVGO) of atmospheric distillates of paraffinic-base and/or mixed-base crude oil; (3) mild hydrocracking (HIX) of distillates (1) and/or (2); (4) mixtures of two or more of (1), (2) and (3); (5) deasphalted oil (DAO) of (1)–(4); (6) mild hydrocracking of oil (5); and (7) mixtures of two or more of (1)–(6). These starting oils may be refined to recover lubricant fractions for ready use or use after they are further purified. This refining or purifying process may be suitably carried out by (i) hydrocracking or hydrorefining, (ii) solvent-extraction as with furfural, (iii) solvent or catalytic dewaxing, (iv) clay treatment such as with acid or active clay and (v) washing with sulfuric acid, caustic soda and the like. These different processes may be used in combination in the order and frequency desired. Needless to mention, other mineral oil mixtures may be equally used as Component (A) as long as they qualify the kinematic viscosity and aromatics content parameters specified herein.

In the case where the base oil for the inventive lubricating oil composition is selected solely from the mineral oil, the above exemplified starting oils (1)–(6) or the lubricant fractions recovered therefrom may be hydrocracked and the resultant reaction product or the lubricant fractions thereof may be subjected to solvent or catalytic dewaxing treatment and further to solvent refining. Alternatively, the resultant product may be further subjected to solvent or catalytic dewaxing treatment. The resulting component (A-1) is used in an amount of more than 50%, preferably more than 70%, more preferably more than 80% by mass of the total Component (A).

The hydrocracking referred to above is carried out in the presence of a suitable catalyst usually at a total pressure of 6–25 MPa, a temperature of 350°–500° C. and an LHSV of 0.1–2.0 hr.–1 such that the cracking conversion exceeds 40% by mass. The catalyst may be chosen from molybudenum, chromium, tungsten, vanadium, platinum, nickel, copper, iron and cobalt and their oxides or sulfides which may be used singly or in combination and deposited if necessary on a suitable carrier such as silica-alumina, active alumina and zeolite.

The component (A-2) is an olefinic homo- or co-polymer or its hydrogenated product having a carbon number of 2–16 and an average molecular weight of 250–4,000.

The olefins referred to herein are those having a carbon number of 2–16, preferably 2–12 which may be alpha-olefins having double-bonds in the terminal ends, inner olefins or straight- or branched-chain olefins. Such olefins exemplarily include ethylene, propylene, 1-butene, 2-butene, isobutene, straight or branched pentene (including α-olefin and inner-olefin), straight or branched hexene (including α-olefin and inner-olefin), straight or branched heptene (including α-olefin and inner-olefin), straight or branched octene (including α-olefin and inner-olefin), straight or branched nonene (including α-olefin and inner-olefin), straight or branched decene (including α-olefin and inner-olefin), straight or branched undecene (including α-olefin and inner-olefin), straight or branched dodecene (including α-olefin and inner-olefin), straight or branched tridecene (including α-olefin and inner-olefin), straight or branched tetradecene (including α-olefin and inner-olefin), straight or branched pentadecene (including α-olefin and inner-olefin), straight or branched hexadecene (including α-olefin and inner-olefin) and mixture thereof, preferably ethylene, propylene, 1-butene, 2-butene, isobutene, 1-octene, 1-decene, 1-dodecene and mixtures thereof.

The olefinic polymers for the component (A-2) are polymers of the above olefins or their hydrogenated products. Those polymers may be derived from random-, alternating- or block-polymerization.

Olefinic homo- or co-polymers usually have double-bonds, but preferred for the component (A-2) are homopolymers or copolymers derived from hydrogenation of said double-bonds in consideration of thermal/oxidative stability.

The component (A-2) is derivable from homopolyemrization or copolymerization of the above olefins by non-catalytic thermal reaction or in the presence of catalysts including organic peroxide catalyst such as benzoyl peroxide; Friedel-Crafts catalysts such as aluminum chloride, aluminum chloride-polyhydric alcohol, aluminum chloride-titanium tetrachloride, aluminum chloride-alkyltin halide and boron fluoride; Ziegler catalysts such as organoaluminum chloride-titanium tetrachloride and organoaluminum-titanium tetrachloride; metallocene catalysts such as aluminoxane-zirconocene and ionic compound-zirconocene; and Lewis acid-complex catalysts such as aluminum chloride-base and boron fluoride-base.

The hydrogenated products may be obtained for example by catalytic hydrogenation to saturate the double-bonds of the polymers. An appropriate choice of catalysts can achieve the polymerization of olefins and the hydrogenation of their double-bonds in a single step of process.

It has been found of particular interest in terms of thermal/oxidative stability, viscosity-temperature characteristics and low-temperature fluidity to use ethylene-propylene copolymers, copolymers derived from polymerization of polybutene fractions such butane-butene (mixtures of 1-butene, 2-butene and isobutene), 1-octene oligomers, 1-decene oligomers, 1-dodecene oligomers and hydrides and mixtures thereof. These hydrides and mixtures are particularly preferred. Also eligible for use as the component (A-2) are such commercially available ethylene-propylene copolymers, polybutenes and poly-alpha-olefins that have their double-bonds already hydrogenated.

The number-average molecular weight range of the component (A-2) according to the invention has a lower limit value of 250, preferably 350 and an upper limit value of 4,000, preferably 1,500. Departures from the lower limit would result in poor lubricating performance of the oil composition due to insufficient oil film formation and in base oil losses by evaporation under elevated temperature conditions. Departures from the upper limit would lead to increased flow resistance, hence increased friction resistance at the lubrication areas.

The component (A-2) has, desirably though not necessarily, a kinematic viscosity of normally 5–200 $mm^2/s$, preferably 10–100 $mm^2/s$ at a temperature of 40° C.

The component (A-3) according to the invention is an alkylbenzene having 1–4 alkyl groups of 1–40, preferably 1–30 carbon atoms and a total carbon number of these alkyl groups in the range of 6–40, preferably 12–40, more preferably 15–30.

Lubricating oil compositions containing an alkylbenzene having less than 6 total carbon number of alkyl groups would fail in lubricity due to insufficient oil film formation and would suffer base oil losses at elevated temperature, while those with greater than 40 total carbon number of alkyl groups would result in increased flow and friction resistance.

The alkyl groups in the component (A-3) include methyl, ethyl, propyl, isopropyl, n-butyl, isobutyl, sec-butyl, tert-butyl, straight or branched butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl, straight or branched tetracosyl, straight or branched pentacosyl, straight or branched hexacosyl, straight or branched heptacosyl, straight or branched octacosyl, straight or branched nonacosyl, straight or branched triacontyl, straight or branched hentriacontyl, straight or branched dotriacontyl, straight or branched tritriacontyl, straight or branched tetracontyl, straight or branched pentacontyl, straight or branched hexacontyl, straight or branched heptacontyl, straight or branched octacontyl, straight or branched nonacontyl and straight or branched tetracontyl groups.

With viscosity-temperature characteristics and low-temperature fluidity taken into account as desired for the invention lubricant composition, the alkyl groups are more preferably of branched-chain than straight-chain and such preferred branched-chain alkyl groups include olefinic oligomer derivatives such as propylene, 1-butene and isobutylene that are readily commercially available.

From the viewpoint of good thermal/oxidative stability and easy commercial access, the most preferred component (A-3) is a monoalkylbenzene and a dialkylbenzene or mixtures thereof.

Needless to mention, the component (A-3) alkylbenzene may be those having a single structure or mixtures of alkylbenzenes having different structures as long as they qualify the carbon atom parameters specified above.

The component (A-3) has a kinematic viscosity in the range of 5–200 $mm^2/s$, preferably 10–100 $mm^2/s$.

The component (A-3) alkylbenzenes may be produced by any suitable procedure typically by the procedure hereinafter described. Aromatic compounds as a starting material exemplarily include benzene, toluene, xylene, ethylbenzene, methylethylbenzene, diethylbenzene and mixtures thereof. The alkylating agent includes lower monoolefins such as ethylene, propylene, butene and isobutene, preferably straight or branched $C_6$–$C_{40}$ olefins resulting from propylene polymerization; straight or branched $C_6$–$C_{40}$ olefins available from the thermal cracking of wax, heavy oil, petroleum fractions, polyethylene and polypropylene; and straight or branched $C_6$–$C_{40}$ olefins derived from separating and catalytically dehydrogenating n-paraffins from kerosene, gas oil and other petroleum fractions.

The alkylation catalyst includes a Friedel-Crafts catalyst such as aluminum chloride and zinc chloride, and an acidic catalyst such as sulfuric acid, phosphoric acid, silicotungstenic acid, hydrofluoric acid and active clay.

In the case where the components (A-2) and/or (A-3) are used as the base oil, there may be used certain mineral oil-based oil, ester-based oil, ether-based oil or mixtures thereof each of which has a kinematic viscosity of 5–200 $mm^2/s$, preferably 10–100 $mm^2/s$ and may be used in a total amount of 40, preferably 30, more preferably 20 mass percent based on total composition, particularly for application for example to rubber sealants with bulging held to a minimum.

The mineral oil-based oil referred to above may be a paraffinic or naphthenic mineral oil made available from atmospheric or vacuum distillation fractions of paraffinic- or mixed-base crude oil which distillation fractions are refined by hydrogenation, solvent-extraction, dewaxing, clay or chemicals (acid/alkali) treatment singly or in combination, or in any order and frequency desired. Such refined fractions may be used regardless of their total aromatics contents. It has now been found however that mineral oils specified as the component (A-1) are superior to any of the aforesaid mineral oil-based oils in respect of the synergistic effect with a fatty acid ester (Component (B)) upon prevention of oxidation and sludge formation as contemplated under the invention.

The ester-based oil referred to above includes diester oil such as ditridecyl glutarate, di-2-ethylhexyl adipate, diisodecyl adipate, ditridecyl adipate and di-3-ethylhexyl sebacate, polyol ester oil such as trimethylolpropane tricaprylate, trimethylolpropane tripelargonate, pentaerythritoltetra(2-ethyl hexanoate), and pentaerythritoltetrapelargonate and mixtures thereof.

The ether-based oil includes polyglycol oils such as polyoxyethylene glycol, polyoxypropylene glycol, polyoxyethyleneoxypropylene glycol and polyoxybutylene glycol, monoalkyl ether, dialkyl ether, diphenyl ether and polyphenylene ether, and mixtures thereof.

Component (B) used in the invention is a 3-methyl-5-tert-butyl-4-hydroxyphenyl-substituted fatty acid ester represented by the formula

I

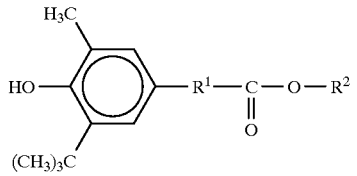

where $R^1$ is a straight or branched alkylene group of 1–6 carbon atoms and $R^2$ is a straight or branched alkyl or alkenyl group of 1–24 carbon atoms.

The alkylene group R1 exemplarily includes methylene, methylmethylene, ethylene (dimethylene), ethylmethlene, propylene (methylethylene), trimethylene, straight or brached butylene, straight or branched pentylene and straight or branched hexylene groups. Most preferred are $C_1$–$C_2$ alkylene groups such as methylene, methylmethylene and ethylene (dimethylene) that may be made available with a minimum of reaction process steps required.

The alkyl or alkenyl groups $R^2$ exemplarily include alkyl group exemplarily including methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl, and straight or branched tetracosyl; and alkenyl group exemplarily including vinyl, propenyl, isopropenyl, straight or branched butenyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl, straight or branched octadecadienyl, straight or branched nonadecenyl, straight or branched eicosenyl, straight or branched heneicosenyl, straight or branched docosenyl, straight or branched tricosenyl and straight or branched tetracosenyl groups.

Preferred examples from the viewpoint of compatibility of Component (B) with the base oil (A) include $C_4$–$C_{18}$ alkyl groups such as n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl, preferably $C_6$–$C_{12}$ straight or branched alkyl, and more preferably $C_6$–$C_{12}$ branched alkyl groups.

It has been found that amongst the above numerous fatty acid esters, the most preferred ones are $R^1$=$C_1$–$C_2$ alkylene groups and $R^2$=$C_6$–$C_{12}$ branched alkyl groups.

Needless to mention, the compound of formula I may be used singly or in combination with other two or more compounds encompassed by formula I in suitable proportions.

Specific examples of Component (B) include (3-methyl-5-tert-butyl-4-hydroxyphenyl) n-hexyl acetate, (3-methyl-5-tert-butyl-4-hydroxyphenyl) isohexyl acetate, (3-methyl-5-tert-butyl-4-hydroxyphenyl) n-heptyl acetate, (3-methyl-5-tert-butyl-4-hydroxyphenyl) isoheptyl acetate, (3-methyl-5-tert-butyl-4-hydroxyphenyl) n-octyl acetate, (3-methyl-5-tert-butyl-4-hydroxyphenyl) isooctyl acetate, (3-methyl-5-tert-butyl-4-hydroxyphenyl) 2-ethyl hexyl acetate, (3-methyl-5-tert-butyl-4-hydroxyphenyl) n-nonyl acetate, (3-methyl-5-tert-butyl-4-hydroxyphenyl) isononyl acetate, (3-methyl-5-tert-butyl-4-hydroxyphenyl) n-decyl acetate, (3-methyl-5-tert-butyl-4-hydroxyphenyl) isodecyl acetate, (3-methyl-5-tert-butyl-4-hydroxyphenyl) n-undecyl acetate, (3-methyl-5-tert-butyl-4-hydroxyphenyl) isoundecyl acetate, (3-methyl-5-tert-butyl-4-hydroxyphenyl) n-dodecyl acetate, (3-methyl-5-tert-butyl-4-hydroxyphenyl) isododecyl acetate, (3-methyl-5-tert-butyl-4-hydroxyphenyl) n-hexyl propionate, (3-methyl-5-tert-butyl-4-hydroxyphenyl) isohexyl propionate, (3-methyl-5-tert-butyl-4-hydroxyphenyl) n-heptyl propionate, (3-methyl-5-tert-butyl-4-hydroxyphenyl) isoheptyl propionate, (3-methyl-5-tert-butyl-4-hydroxyphenyl) n-octyl propionate, (3-methyl-5-tert-butyl-4-hydroxyphenyl) isooctyl propionate, (3-methyl-5-tert-butyl-4-hydroxyphenyl) 2-ethylhexyl propionate, (3-methyl-5-tert-butyl-4-hydroxyphenyl) n-nonyl propionate, (3-methyl-5-tert-butyl-4-hydroxyphenyl) isononyl propionate, (3-methyl-5-tert-butyl-4-hydroxyphenyl) n-decyl propionate, (3-methyl-5-tert-butyl-4-hydroxyphenyl) isodecyl propionate, (3-methyl-5-tert-butyl-4-hydroxyphenyl) n-undecyl propionate, (3-methyl-5-tert-butyl-4-hydroxyphenyl) isoundecyl propionate, (3-methyl-5-tert-butyl-4-hydroxyphenyl) n-dodecyl propionate and (3-methyl-5-tert-butyl-4-hydroxyphenyl) isododecyl propionate. These esters may be also used in combination.

The 3-methyl-5-tert-butyl-4-hydroxyphenyl-substituted fatty acid ester for Component (B) may be prepared by any known processes, for instance by reacting a 2-methyl-6-tert-butylphenol with methylacrylate in the presence of a basic catalyst such as metallic sodium to produce (3-methyl-5-tert-butyl-4-hydroxyphenyl)methyl propionate. This propionate may be subjected to ester-exchange reaction with a $C_2$–$C_{24}$ aliphatic alcohol to obtain an esterified compound. The content of Component (B) in the inventive lubricant composition is in the range of between 0.1, preferably 0.2 and 5.0, preferably 3.0 percent by mass. Contents less than the lower limit of the specified range would result in reduced oxidative-stability and if in excess of the upper limit would not give so much oxidative-stability, merely leading to economically infeasible usage.

Component (C) of the inventive lubricant composition is an auxiliary component which is one member of the group consisting of (a) a nitrogen-containing compound, (b) a sulfur and/or phosphorous-containing compound and (c) a phenolic compound.

The nitrogen-containing compound (a) is selected from the group consisting of (a-1) thiadiazole, (a-2) benzotriazole and/or its deivative and (a-3) benzothiazole.

The component (a-1) encompasses a thiadiazole compound represented by the formula

II

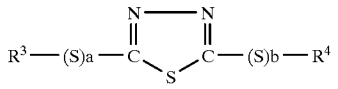

wherein $R^3$ is a straight or branched alkyl group of 1–30, preferably 6–24 carbon atoms, $R^4$ is hydrogen or a straight or branched alkyl group of 1–30, preferably 1–24 carbon atoms, and a and b each are an integer of 1–3, preferably 1 or 2.

The alkyl group $R^3$ exemplarily includes methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl, straight or branched tetracosyl, straight or branched pentacosyl, straight or branched hexacosyl, straight or branched heptacosyl, straight or branched octacosyl, straight or branched nonacosyl and straight or branched triacontyl.

Specific examples of $R^4$ are hydrogen and $C_1$–$C_{30}$ alkyl groups exemplified above.

From the viewpoint of excelled antioxidation capability desired for the inventive lubricant composition, preferred amongst the thiadiazole compounds of formula (II) are those of formula (II) wherein $R^3$ is an alkyl group of 6–24 carbon atoms, $R^4$ is hydrogen or an alkyl group of 1–24 carbon atoms, and a and b each are 1 or 2. More preferred are the thiadiazole compounds represented by formula (II) wherein $R^3$ is an alkyl group of 6–24 carbon atoms, $R^4$ is hydrogen or an alkyl group of 1–24 carbon atoms, a is 1 and 2 and b is 1.

Specific examples of thiadiazole (a-1) are 2,5-bis(straight or branched hexylthio)-1,3,4-thiadiazole, 2,5-bis(straight or branched heptylthio)-1,3,4-thiadiazole, 2,5-bis(straight or branched octylthio)-1,3,4-thiadiazole, 2,5-bis(straight or branched nonylthio)-1,3,4-thiadiazole, 2,5-bis(straight or branched decylthio)-1,3,4-thiadiazole, 2,5-bis(straight or branched undecylthio)-1,3,4-thiadiazole, 2,5-bis(straight or branched dodecylthio)-1,3,4-thiadiazole, 2,5-bis(straight or branched tridecylthio)-1,3,4-thiadiazole, 2,5-bis(straight or branched tetradecylthio)-1,3,4-thiadiazole, 2,5-bis(straight or branched pentadecylthio)-1,3,4-thiadiazole, 2,5-bis(straight or branched hexadecylthio)-1,3,4-thiadiazole, 2,5-bis(straight or branched heptadecylthio)-1,3,4-thiadiazole, 2,5-bis(straight or branched octadecylthio)-1,3,4-thiadiazole, 2,5-bis(straight or branched nonadecylthio)-1,3,4-thiadiazole, 2,5-bis(straight or branched eicosylthio)-1,3,4-thiadiazole, 2,5-bis(straight or branched heneicosylthio)-1,3,4-thiadiazole, 2,5-bis(straight or branched docosylthio)-1,3,4-thiadiazole, 2,5-bis(straight or branched tricosylthio)-1,3,4-thiadiazole, 2,5-bis(straight or branched tetracosylthio)-1,3,4-thiadiazole, 2,5-bis(straight or branched hexyldithio)-1,3,4-thiadiazole, 2,5-bis(straight or branched heptyldithio)-1,3,4-thiadiazole, 2,5-bis(straight or branched octyldithio)-1,3,4-thiadiazole, 2,5-bis(straight or branched nonyldithio)-1,3,4-thiadiazole, 2,5-bis(straight or branched decyldithio)-1,3,4-thiadiazole, 2,5-bis(straight or branched undecyldithio)-1,3,4-thiadiazole, 2,5-bis (straight or branched dodecyldithio)-1,3,4-thiadiazole, 2,5-bis(straight or branched tridecyldithio)-1,3,4-thiadiazole, 2,5-bis(straight or branched tetradecyldithio)-1,3,4-thiadiazole, 2,5-bis(straight or branched pentadecyldithio)-1,3,4-thiadiazole, 2,5-bis(straight or branched hexadecyldithio)-1,3,4-thiadiazole, 2,5-bis(straight or branched heptadecyldithio)-1,3,4-thiadiazole, 2,5-bis (straight or branched octadecyldithio)-1,3,4-thiadiazole, 2,5-bis(straight or branched nonadecyldithio)-1,3,4-thiadiazole, 2,5-bis(straight or branched eicosyldithio)-1,3,4-thiadiazole, 2,5-bis(straight or branched heneicosyldithio)-1,3,4-thiadiazole, 2,5-bis(straight or branched docosyldithio)-1,3,4-thiadiazole, 2,5-bis(straight or branched tricosyldithio)-1,3,4-thiadiazole, 2,5-bis (straight or branched tetracosyldithio)-1,3,4-thiadiazole, 2-(straight or branched hexylthio)-5-mercapto-1,3,4-thiadiazole, 2-(straight or branched heptylthio)-5-mercapto-1,3,4-thiadiazole, 2-(straight or branched octylthio)-5-mercapto-1,3,4-thiadiazole, 2-(straight or branched nonylthio)-5-mercapto-1,3,4-thiadiazole, 2-(straight or branched decylthio)-5-mercapto-1,3,4-thiadiazole, 2-(straight or branched undecylthio)-5-mercapto-1,3,4-thiadiazole, 2-(straight or branched dodecylthio)-5-mercapto-1,3,4-thiadiazole, 2-(straight or branched tridecylthio)-5-mercapto-1,3,4-thiadiazole, 2-(straight or branched tetradecylthio)-5-mercapto-1,3,4-thiadiazole, 2-(straight or branched pentadecylthio)-5-mercapto-1,3,4-thiadiazole, 2-(straight or branched hexadecylthio)-5-mercapto-1,3,4-thiadiazole, 2-(straight or branched heptadecylthio)-5-mercapto-1,3,4-thiadiazole, 2-(straight or branched octadecylthio)-5-mercapto-1,3,4-thiadiazole, 2-(straight or branched nonadecylthio)-5-mercapto-1,3,4-thiadiazole, 2-(straight or branched eicosylthio)-5-mercapto-1,3,4-thiadiazole, 2-(straight or branched heneicosylthio)-5-mercapto-1,3,4-thiadiazole, 2-(straight or branched docosylthio)-5-mercapto-1,3,4-thiadiazole, 2-(straight or branched tricosylthio)-5-mercapto-1,3,4-thiadiazole, 2-(straight or branched tetracosylthio)-5-mercapto-1,3,4-thiadiazole, 2-(straight or branched hexyldithio)-5-mercapto-1,3,4-thiadiazole, 2-(straight or branched heptyldithio)-5-mercapto-1,3,4-thiadiazole, 2-(straight or branched octyldithio)-5-mercapto-1,3,4-thiadiazole, 2-(straight or branched nonyldithio)-5-mercapto-1,3,4-thiadiazole, 2-(straight or branched decyldithio)-5-mercapto-1,3,4-thiadiazole, 2-(straight or branched undecyldithio)-5-mercapto-1,3,4-thiadiazole, 2-(straight or branched dodecyldithio)-5-mercapto-1,3,4-thiadiazole, 2-(straight or branched tridecyldithio)-5-mercapto-1,3,4-thiadiazole, 2-(straight or branched tetradecyldithio)-5-mercapto-1,3,4-thiadiazole, 2-(straight or branched pentadecyldithio)-5-mercapto-1,3,4-thiadiazole, 2-(straight or branched hexadecyldithio)-5-mercapto-1,3,4-thiadiazole, 2-(straight or branched heptadecyldithio)-5-mercapto-1,3,4-thiadiazole, 2-(straight or branched octadecyldithio)-5-mercapto-1,3,4-thiadiazole, 2-(straight or branched nonadecyldithio)-5-mercapto-1,3,4-thiadiazole, 2-(straight or branched eicosyldithio)-5-mercapto-1,3,4-thiadiazole, 2-(straight or branched heneicosyldithio)-5-mercapto-1,3,4-thiadiazole, 2-(straight or branched docosyldithio)-5-mercapto-1,3,4-thiadiazole, 2-(straight or branched tricosyldithio)-5-mercapto-1,3,4-thiadiazole, 2-(straight or branched tetracosyldithio)-5-mercapto-1,3,4-thiadiazole and mixture thereof.

The component (a-2), i.e. benzotriazole, encompasses compound represented by the formula

III

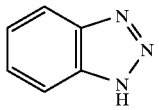

One alternative for the component (a-2), i.e. benzotriazole derivative is alkylbenzotriazole represented by the formula

IV

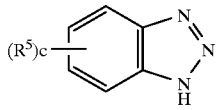

wherein $R^5$ is a straight or branched alkyl group of 1–4 carbon atoms, preferably methyl or ethyl group and c is an integer of 1–3, preferably 1 or 2.

The alkyl group $R^5$ exemplarily includes methyl, ethyl, n-propyl, isopropyl, n-butyl, isobutyl, sec-butyl and tert-butyl groups.

In consideration of good antioxidation performance of the inventive lubricant composition, $R^5$ is preferably methyl or ethyl group and c is preferably 1 or 2. Preferred alkylbenzotriazole are methylbenzotriazole (tolyltriazole), dimethylbenzotriazole, ethylbenzotriazole, ethylmethylbenzotriazole, diethylbenzotriazole and mixtures thereof.

Another benzotriazole derivative for the component (a-2) is (alkyl)aminoalkylbenzotriazole represented by the formula

V

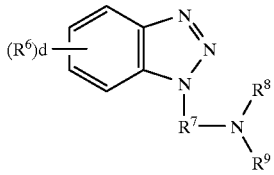

wherein $R^6$ is a straight or branched alkyl group of 1–4 carbon atoms, preferably methyl or ethyl group, $R^7$ is methylene or ethylene group, $R^8$ and $R^9$ each are a hydrogen atom or a straight or branched alkyl group of 1–18 carbon atoms, preferably branched alkyl group of 1–12 carbon atoms and d is an integer of 0–3, preferably 0 or 1.

The group $R^6$ exemplarily includes methyl, ethyl, n-propyl, isopropyl, n-butyl, isobutyl, sec-butyl and tert-butyl groups.

$R^8$ and $R^9$ exemplarily include a hydrogen atom and an alkyl group such as methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl groups.

For better antioxidation performance of the inventive composition, preferred (alkyl)aminoalkylbenzotriazoles are those of formula (V) wherein $R^6$ is methyl group, d is 0 or 1, $R^7$ is methylene or ethylene group and $R^8$ and $R^9$ are straight or branched alkyl groups of 1–12 carbon groups, such as dialkylaminoalkylbenzotriazole, dialkylaminoalkyltolyltriazole and mixtures thereof.

Specific examples of dialkylaminoalkylbenzotriazole include dimethylaminomethylbenztriazole, diethylaminomethylbenztriazole, di(straight or branched) propylaminomethylbenztriazole, di(straight or branched) butylaminomethylbenztriazole, di(straight or branched) pentylaminomethylbenztriazole, di(straight or branched) hexylaminomethylbenztriazole, di(straight or branched) heptylaminomethylbenztriazole, di(straight or branched) octylaminomethylbenztriazole, di(straight or branched) nonylaminomethylbenztriazole, di(straight or branched) decylaminomethylbenztriazole, di(straight or branched) undecylaminomethylbenztriazole, di(straight or branched) dodecylaminomethylbenztriazole, dimethylaminoethylbenztriazole, diethylaminoethylbenztriazole, di(straight or branched) propylaminoethylbenztriazole, di(straight or branched) butylaminoethylbenztriazole, di(straight or branched) pentylaminoethylbenztriazole, di(straight or branched) hexylaminoethylbenztriazole, di(straight or branched) heptylaminoethylbenztriazole, di(straight or branched) octylaminoethylbenztriazole, di(straight or branched) nonylaminoethylbenztriazole, di(straight or branched) decylaminoethylbenztriazole, di(straight or branched) undecylaminoethylbenztriazole and di(straight or branched) dodecylaminoethylbenztriazole. Specific example of dialkylaminoalkyltolyltriazole are dimethylaminomethyltolyltriazole, diethylaminomethyltolyltriazole, di(straight or branched) propylaminomethyltolyltriazole, di(straight or branched) butylaminomethyltolyltriazole, di(straight or branched) pentylaminomethyltolyltriazole, di(straight or branched) hexylaminomethyltolyltriazole, di(straight or branched) heptylaminomethyltolyltriazole, di(straight or branched) octylaminomethyltolyltriazole, di(straight or branched) nonylaminomethyltolyltriazole, di(straight or branched) decylaminomethyltolyltriazole, di(straight or branched) undecylaminomethyltolyltriazole, di(straight or branched) dodecylaminomethyltolyltriazole, dimethylaminoethyltolyltriazole, diethylaminoethyltolyltriazole, di(straight or branched) propylaminoethyltolyltriazole, di(straight or branched) butylaminoethyltolyltriazole, di(straight or branched) pentylaminoethyltolyltriazole, di(straight or branched) hexylaminoethyltolyltriazole, di(straight or branched) heptylaminoethyltolyltriazole, di(straight or branched) octylaminoethyltolyltriazole, di(straight or branched) nonylaminoethyltolyltriazole, di(straight or branched) decylaminoethyltolyltriazole, di(straight or branched) undecylaminoethyltolyltriazole and di(straight or branched) dodecylaminoethyltolyltriazole.

The component (a-3), i.e. benzothiazole is a compound represented by the formula

VI

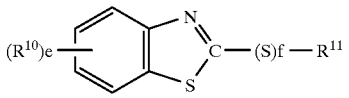

wherein $R^{10}$ is a straight or branched alkyl group of 1–4 carbon atoms, preferably methyl or ethyl group, $R^{11}$ is a straight or branched alkyl group of 1–30, preferably 6–24 carbon atoms, e is an integer of 0–3, preferably 0 or 1 and f is an integer of 1–3, preferably 1 or 2.

Specific examples of $R^{10}$ are methyl, ethyl, n-propyl, isoprobyl, n-butyl, isobutyl, sec-butyl and tert-butyl groups.

Specific examples of $R^{11}$ are an alkyl group such as methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl, straight or branched tetracosyl, straight or branched pentacosyl, straight or branched hexacosyl, straight or branched heptacosyl, straight or branched octacosyl, straight or branched nonacosyl and straight or branched triacontyl.

To achieve excelled antioxidation capabilities, preferred benzothiazoles are those of formula (VI) wherein $R^{10}$ is methyl or ethyl group, $R^{11}$ is a straight or branched alkyl group of 6–24 carbon atoms, e is an integer of 0 or 1 and f is an integer of 1 or 2.

Particularly preferred components (a-3) are 2-(straight or branched hexylthio)-benzothiazole, 2-(straight or branched heptylthio)-benzothiazole, 2-(straight or branched octylthio)-benzothiazole, 2-(straight or branched nonylthio)-benzothiazole, 2-(straight or branched decylthio)-benzothiazole, 2-(straight or branched undecylthio)-benzothiazole, 2-(straight or branched dodecylthio)-benzothiazole, 2-(straight or branched tridecylthio)-benzothiazole, 2-(straight or branched tetradecylthio)-benzothiazole, 2-(straight or branched pentadecylthio)-benzothiazole, 2-(straight or branched hexadecylthio)-benzothiazole, 2-(straight or branched heptadecylthio)-benzothiazole, 2-(straight or branched octadecylthio)-benzothiazole, 2-(straight or branched nonadecylthio)-benzothiazole, 2-(straight or branched eicosylthio)-benzothiazole, 2-(straight or branched heneicosylthio)-benzothiazole, 2-(straight or branched docosylthio)-benzothiazole, 2-(straight or branched tricosylthio)-benzothiazole, 2-(straight or branched tetracosylthio)-benzothiazole, 2-(straight or branched hexylthio)-methylbenzothiazole, 2-(straight or branched heptylthio)-methylbenzothiazole, 2-(straight or branched octylthio)-methylbenzothiazole, 2-(straight or branched nonylthio)-methylbenzothiazole, 2-(straight or branched decylthio)-methylbenzothiazole, 2-(straight or branched undecylthio)-methylbenzothiazole, 2-(straight or branched dodecylthio)-methylbenzothiazole, 2-(straight or branched tridecylthio)-methylbenzothiazole, 2-(straight or branched tetradecylthio)-methylbenzothiazole, 2-(straight or branched pentadecylthio)-methylbenzothiazole, 2-(straight or branched hexadecylthio)-methylbenzothiazole, 2-(straight or branched heptadecylthio)-methylbenzothiazole, 2-(straight or branched octadecylthio)-methylbenzothiazole, 2-(straight or branched nonadecylthio)-methylbenzothiazole, 2-(straight or branched eicosylthio)-methylbenzothiazole, 2-(straight or branched heneicosylthio)-methylbenzothiazole, 2-(straight or branched docosylthio)-methylbenzothiazole, 2-(straight or branched tricosylthio)-methylbenzothiazole, 2-(straight or branched tetracosylthio)-methylbenzothiazole, 2-(straight or branched hexyldithio)-benzothiazole, 2-(straight or branched heptyldithio)-benzothiazole, 2-(straight or branched octyldithio)-benzothiazole, 2-(straight or branched nonyldithio)-benzothiazole, 2-(straight or branched decyldithio)-benzothiazole, 2-(straight or branched undecyldithio)-benzothiazole, 2-(straight or branched dodecyldithio)-benzothiazole, 2-(straight or branched tridecyldithio)-benzothiazole, 2-(straight or branched tetradecyldithio)-benzothiazole, 2-(straight or branched pentadecyldithio)-benzothiazole, 2-(straight or branched hexadecyldithio)-benzothiazole, 2-(straight or branched heptadecyldithio)-benzothiazole, 2-(straight or branched octadecyldithio)-benzothiazole, 2-(straight or branched nonadecyldithio)-benzothiazole, 2-(straight or branched eicosyldithio)-benzothiazole, 2-(straight or branched heneicosyldithio)-benzothiazole, 2-(straight or branched docosyldithio)-benzothiazole, 2-(straight or branched tricosyldithio)-benzothiazole, 2-(straight or branched tetracosyldithio)-benzothiazole, 2-(straight or branched hexyldithio)-methylbenzothiazole, 2-(straight or branched heptyldithio)-methylbenzothiazole, 2-(straight or branched octyldithio)-methylbenzothiazole, 2-(straight or branched nonyldithio)-methylbenzothiazole, 2-(straight or branched decyldithio)-methylbenzothiazole, 2-(straight or branched undecyldithio)-methylbenzothiazole, 2-(straight or branched dodecyldithio)-methylbenzothiazole, 2-(straight or branched tridecyldithio)-methylbenzothiazole, 2-(straight or branched tetradecyldithio)-methylbenzothiazole, 2-(straight or branched pentadecyldithio)-methylbenzothiazole, 2-(straight or branched hexadecyldithio)-methylbenzothiazole, 2-(straight or branched heptadecyldithio)-methylbenzothiazole, 2-(straight or branched octadecyldithio)-methylbenzothiazole, 2-(straight or branched nonadecyldithio)-methylbenzothiazole, 2-(straight or branched eicosyldithio)-methylbenzothiazole, 2-(straight or branched heneicosyldithio)-methylbenzothiazole, 2-(straight or branched docosyldithio)-methylbenzothiazole, 2-(straight or branched tricosyldithio)-methylbenzothiazole, 2-(straight or branched tetracosyldithio)-methylbenzothiazole and mixtures thereof.

The nitrogen-containing compound (a) may be a single compound selected from the components (a-1), (a-2) and (a-3) or mixtures containing two or more of the compounds selected from each of the components (a-1), (a-2) and (a-3) in any suitable blend proportions. Alternatively, there may be used mixtures comprising the combinations of one or more of the components (a-1) and one or more of the components (a-2), the combinations of one or more of the components (a-1) and one or more of the components (a-3) or the combinations of one or more of the components (a-2) and one or more of the components (a-3) in any suitable blend proportions. Further alternatively, there may be also used mixtures comprising the combination of one or more of the components (a-1), one or more of the components (a-2) and one or more of the components (a-3) in any suitable blend proportions. The content of the nitrogen-containing compound (a) in the inventive lubricant composition is in the range of between 0.001, preferably 0.005 and 1.0, preferably 0.5 percent by mass based on total composition. Contents less than the lower limit of the specified range would result in reduced oxidative-stability and if in excess of the upper limit would not give so much oxidative-stability, merely leading to economically infeasible usage.

The component (b) used in the invention is a sulfur and/or phosphorus-containing compound selected from the group consisting of (b-1) sulfides, (b-2) phosphides, (b-3) dithiophosphates and (b-4) dithiocarbamates.

The components (b-1), i.e. sulfides encompasses a dihydrocarbylpolysulfide represented by the formula $$R^{12}\text{-}S_g\text{-}R^{13} \qquad \text{VII}$$

wherein $R^{12}$ and $R^{13}$ may be the same or different and each are a straight or branched alkyl group of 1–22 carbon atoms, aryl group of 6–20 carbon atoms, alkylaryl group of 7–20 carbon atoms or arylalkyl group of 7–20 carbon atoms and g is an integer of 1–5, preferably 1 and 2, more preferably 2.

Specific examples of the groups $R^{12}$ and $R^{13}$ are an alkyl group such as methyl, ethyl, n-propyl, isopropyl, n-butyl, isobutyl, sec-butyl, tert-butyl, straight or branched pentyl, straight or branched hexyl, cyclohexyl, straight or branched heptyl, straight or branched octyl (tert-octyl), straight or branched nonyl, straight or branched decyl, straight or branched undecyl, straight or branched dodecyl (tert-dodecyl), straight or branched tridecyl, straight or branched tetradecyl, straight or branched pentadecyl, straight or branched hexadecyl (2-methylpentadecyl and tert-hexadecyl), straight or branched heptadecyl, straight or branched octadecyl, straight or branched nonadecyl, straight or branched eicosyl, straight or branched heneicosyl and straight or branched docosyl; an alkenyl group such as propenyl and butenyl; an aryl group such as phenyl and naphthyl (inclusive of all isomers); an alkylaryl group (the alkyl group may be straight or branched and bonded to any position of the aromatic ring) such as tolyl, ethylphenyl, propylphenyl, butylphenyl, pentylphenyl, hexylphenyl, heptylphenyl, octylphenyl, nonylphenyl, decylphenyl, undecylphenyl, dodecylphenyl, xylyl, ethylmethylphenyl, diethylphenyl, dipropylphenyl, dibutylphenyl, methylnaphthyl,ethylnaphthyl, propylnaphthyl, butylnaphthyl, dimethylnaphthyl, ethylmethylnaphthyl, diethylnaphthyl, dipropylnaphthyl and dibutylnaphthyl; and an arylalkyl group (the aromatic ring may be bonded to any position of the straight or branched carbon chain) such as benzyl, phenethyl and phenylpropyl.

Amongst these groups, preferred are a $C_3$–$C_{18}$ alkyl group derived from propylene or isobutene, $C_6$–$C_8$ aryl group, $C_7$–$C_8$ alkylaryl group and $C_7$–$C_8$ arylalkyl group. More preferred are an alkyl group such as isopropyl group, branched hexyl group derived from propylene dimer, branched nonyl group derived from propylene trimer, branched dodecyl group derived from propylen tetramer, branched pentadecyl group derived from propylene pentamer, branched octadecyl group derived from propylene hexamer, tert-butyl group, branched octyl group derived from isobutene dimer, branched dodecyl group derived from isobutene trimer and branched hexadecyl group derived from isobutene tetramer (inclusive of all chain isomers); an alkenyl group such as propenyl group and butenyl group; an alkylaryl group such as phenyl group and tolyl group, ethylphenyl and xylyl group (the alkyl groups of these alkylaryl group may be straight or branched and bonded to any position of the aromatic rings); an arylalkyl group such as benzyl group and phenylethyl group (the phenyl group thereof may be bonded to any position of the carbon chain) of which $C_3$–$C_{18}$, preferably $C_6$–$C_{15}$ alkyky groups derived from propylene or isobutene are more preferred.

Specific examples of the dihydrocarbylpolysulfide of formula (VII) are dimethylpolysulfide such as dimethylmonosulfide and dimethyldisulfide, diethylpolysulfide such as diethylmonosulfide and diethyldisulfide, di-n-propylpolysulfide such as di-n-propylmonosulfide and di-n-propyldisulfide, diisopropylpolysulfide such as diisopropylmonosulfide and diisopropyldisulfide, di-n-butylpolysulfide such as di-n-butylmonosulfide and di-n-butyldisulfide, diisobutylpolysulfide such as diisobutylmonosulfide and diisobutyldisulfide, di-sec-butylpolysulfide such as di-sec-butylmonosulfide and di-sec-butyldisulfide, di-tert-butylpolysulfide such as di-tert-butylmonosulfide and di-tert-butyldisulfide, di(straight or branched pentyl) polysulfide such as di(straight or branched pentyl) monosulfide and di(straight or branched pentyl)disulfide, di(straight or branched hexyl)polysulfide such as di(straight or branched hexyl)mono sulfide and di(straight or branched hexyl)di sulfide, dicyclohexylpolysulfide such as dicyclohexylmonosulfide and dicyclohexyldisulfide, di(straight or branched heptyl)polysulfide such as di(straight or branched heptyl)monosulfide and di(straight or branched heptyl) disulfide, di-tert-octylpolysulfide such as di-tert-octylmonosufide and di-tert-octyldisulfide, di(straight or branched octyl)polysulfide such as di(straight or branched octyl)monosulfide and di(straight or branched octyl) disulfide, di(straight or branched nonyl)polysulfide such as di(straight or branched nonyl)monosulfide and di(straight or branched nonyl)disulfide, di(straight or branched decyl) polysulfide such as di(straight or branched decyl) monosulfide and di(straight or branched decyl)disulfide, di(straight or branched undecyl)polysulfide such as di(straight or branched undecyl)monosulfide and di(straight or branched undecyl)disulfide, di-tert-dodecylpolysulfide such as di-tert-dodecylmonosulfide and di-tert-dodecyldisulfide, di(straight or branched dodecyl) polysulfide such as di(straight or branched dodecyl) monosulfide and di(straight or branched dodecyl)disulfide, di(straight or branched tridecyl)polysulfide such as di(straight or branched tridecyl)monosulfide and di(straight or branched tridecyl)disulfide, di(straight or branched tetradecyl)polysulfide such as di(straight or branched tetradecyl)monosulfide and di(straight or branched tetradecyl)disulfide, di(straight or branched pentadecyl) polysulfide such as di(straight or branched pentadecyl) monosulfide and di(straight or branched pentadecyl) disulfide, di-2-methylpentadecylpolysulfide such as di-2-methylpentadecylmonosulfide and di-2-methylpentadecyldisulfide, di-tert-hexadecylpolysulfide such as di-tert-hexadecylmonosulfide and di-tert-hexadecyldisulfide, di(straight or branched hexadecyl) polysulfide such as di(straight or branched hexadecyl) monosulfide and di(straight or branched hexadecyl) disulfide, di(straight or branched heptadecyl)polysulfide such as di(straight or branched heptadecyl)monosulfide and di(straight or branched heptadecyl)disulfide, di(straight or branched octadecyl)polysulfide such as di(straight or branched octadecyl)monosulfide and di(straight or branched octadecyl)disulfide, di(straight or branched nonadecyl) polysulfide such as di(straight or branched nonadecyl) monosulfide and di(straight or branched nonadecyl) disulfide, di(straight or branched eicosyl)polysulfide such as di(straight or branched eicosyl)monosulfide and di(straight or branched eicosyl)disulfide, di(straight or branched heneicosyl)polysulfide such as di(straight or branched heneicosyl)monosulfide and di(straight or branched heneicosyl)disulfide, di(straight or branched docosyl) polysulfide such as di(straight or branched docosyl) monosulfide and di(straight or branched docosyl)disulfide, dipropenylpolysulfide such as dipropenylmonosulfide and dipropenyldisulfide, dibutenylpolysulfide such as dibutenylmonosulfide and dibutenyldisulfide, diphenylpolysulfide such as diphenylmonosulfide and diphenyldisulfide, dinaphthylpolysulfide such as dinaphthylmonosulfide and dinaphthyldisulfide, ditolylpolysulfide such as ditolylmonosulfide and ditolyldisulfide, diethylphenylpolysulfide such as diethylphenylmonosulfide and diethylphenyldisulfide, dipropylpolysulfide such asdipropylmonosulfide and dipropyldisulfide, dibutylphenylpolysulfide such as dibutylphenylmonosulfide and dibutylphenyldisulfide, dipentylphenylpolysulfide such as dipentylphenylmonosulfide and dipentylphenyldisulfide, dihexylphenylpolysulfide such as dihexylphenylmonosulfide and dihexylphenyldisulfide, diheptylphenylpolysulfide such as diheptylphenylmonosulfide and diheptylphenyldisulfide, dioctylphenylpolysulfide such as dioctylphenylmonosulfide and dioctylphenyldisulfide, dinonylphenylpolysulfide such as dinonylphenylmonosulfide and dinonylphenyldisulfide, didecylphenylpolysulfide such as didecylphenylmonosulfide and didecylphenyldisulfide, diundecylphenylpolysulfide such as diundecylphenylmonosulfide and diundecylphenyldisulfide, didodecylphenylpolysulfide such as didodecylphenylmonosulfide and didodecylphenyldisulfide, dixylylpolysulfide such as dixylylmonosulfide and dixylyldisulfide, diethylmethylphenylpolysulfide such as diethylmethylphenylmonosulfide and diethylmethylphenyldisulfide, di(diethylphenyl)polysulfide such as di(diethylphenyl)monosulfide and di(diethylphenyl) disulfide, di(dipropylphenyl)polysulfide such as di(dipropylphenyl)monosulfide and di(dipropylphenyl) disulfide, di(dibutylphenyl)polysulfide such as di(dibutylphenyl)monosulfide and di(dibutylphenyl) disulfide, dimethylnaphthylpolysulfide such as dimethylnaphthylmonosulfide and dimethylnaphthyldisulfide, diethylnaphthylpolysulfide such as diethylnaphthylmonosulfide and diethylnaphthyldisulfide, dipropylnaphthylpolysulfide such as dipropylnaphthylmonosulfide and dipropylnaphthyldisulfide, dibutylnaphthylpolysulfide such as dibutylnaphthylmonosulfide and dibutylnaphthyldisulfide, dibenzylpolysulfide such as dibenzylmonosulfide and dibenzyldisulfide, diphenethylpolysulfide such as diphenethylmonosulfide and diphenethyldisulfide, diphenylpropylpolysulfide such as diphenylpropylmonosulfide and diphenylpropyldisulfide and mixtures thereof.

An alternative for the component (b-1) is diesterpolysulfide represented by the formula $$R^{12}OCO(CH_2)_hS_j(CH_2)_kCOOR^{15} \quad \text{VIII}$$

wherein $R^{14}$ and $R^{15}$ may be the same or different and each are a straight or branched alkyl group of 2–20, preferably 4–20 carbon atoms, h and k may be the same or different interger of 2–5, preferably 2 and j is an interger of 1 and 2, preferably 2.

The alkyl groups $R^{14}$ and $R^{15}$ exemplarily include ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl and straight or branched eicosyl groups.

Specific examples of the diesterpolysulfide of formula (VIII) are $C_2H_9OCO(CH_2)_2S(CH_2)_2COOC_4H_9$, $C_2H_9OCO(CH_2)_2S_2(CH_2)_2COOC_4H_9$, $C_5H_{11}OCO(CH_2)_2S(CH_2)_2COOC_5H_{11}$, $C_5H_{11}OCO(CH_2)_2S_2(CH_2)_2COOC_5H_{11}$, $C_6H_{13}OCO(CH_2)_2S(CH_2)_2COOC_6H_{13}$, $C_6H_{13}OCO(CH_2)_2S_2(CH_2)_2COOC_6H_{13}$, $C_7H_{15}OCO(CH_2)_2S(CH_2)_2COOC_7H_{15}$, $C_7H_{15}OCO(CH_2)_2S_2(CH_2)_2COOC_7H_{15}$, $C_8H_{17}OCO(CH_2)_2S(CH_2)_2COOC_8H_{17}$, $C_8H_{17}OCO(CH_2)_2S_2(CH_2)_2COOC_8H_{17}$, $C_9H_{19}OCO(CH_2)_2S(CH_2)_2COOC_9H_{19}$, $C_9H_{19}OCO(CH_2)_2S_2(CH_2)_2COOC_9H_{19}$, $C_{10}H_{21}OCO(CH_2)_2S(CH_2)_2COOC_{10}H_{21}$, $C_{10}H_{21}OCO(CH_2)_2S_2(CH_2)_2COOC_{10}H_{21}$, $C_{11}H_{23}OCO(CH_2)_2S(CH_2)_2COOC_{11}H_{23}$, $C_{11}H_{23}OCO(CH_2)_2S_2(CH_2)_2COOC_{11}H_{23}$, $C_{12}H_{25}OCO(CH_2)_2S(CH_2)_2COOC_{12}H_{25}$, $C_{12}H_{25}OCO(CH_2)_2S_2(CH_2)_2COOC_{12}H_{25}$, $C_{13}H_{27}OCO(CH_2)_2S(CH_2)_2COOC_{13}H_{27}$, $C_{13}H_{27}OCO(CH_2)_2S_2(CH_2)_2COOC_{12}H_{27}$, $C_{14}H_{29}OCO(CH_2)_2S(CH_2)_2COOC_{14}H_{29}$, $C_{14}H_{29}OCO(CH_2)_2S_2(CH_2)_2COOC_{14}H_{29}$, $C_{15}H_{31}OCO(CH_2)_2S(CH_2)_2COOC_{15}H_{31}$, $C_{15}H_{31}OCO(CH_2)_2S_2(CH_2)_2COOC_{15}H_{31}$, $C_{16}H_{33}OCO(CH_2)_2S(CH_2)_2COOC_{16}H_{33}$, $C_{16}H_{33}OCO(CH_2)_2S_2(CH_2)_2COOC_{16}H_{33}$, $C_{17}H_{35}OCO(CH_2)_2S(CH_2)_2COOC_{17}H_{35}$, $C_{17}H_{35}OCO(CH_2)_2S_2(CH_2)_2COOC_{17}H_{35}$, $C_{18}H_{37}OCO(CH_2)_2S(CH_2)_2COOC_{18}H_{37}$, $C_{18}H_{37}OCO(CH_2)_2S_2(CH_2)_2COOC_{18}H_{37}$, $C_{19}H_{39}OCO(CH_2)_2S(CH_2)_2COOC_{19}H_{39}$, $C_{19}H_{39}OCO(CH_2)_2S_2(CH_2)_2COOC_{19}H_{39}$, $C_{20}H_{41}OCO(CH_2)_2S(CH_2)_2COOC_{20}H_{41}$, $C_{20}H_{41}OCO(CH_2)_2S_2(CH_2)_2COOC_{20}H_{41}$ and mixtures thereof.

Another alternative for the component (b-1) is a tetraestertetrasulfide represented by the formula $$(R^{16}SCH_2CH_2COOCH_2)_4C \qquad \text{VIV}$$

wherein $R^{16}$ is a straight or branched alkyl group of 8–20, preferably 12–13 carbon atoms. The group $R^{16}$ exemplarily includes a straight or branched octyl group, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl group and straight or branched icocyl group. Particularly preferred are a straight or branched dodecyl and straight or branched tridecyl groups.

Specific examples of the tetraestertetrasulfides of formula XIV are $(C_8H_{17}SCH_2CH_2COOCH_2)_4C$, $(C_9H_{19}SCH_2CH_2COOCH_2)_4C$, $(C_{10}H_{21}SCH_2CH_2COOCH_2)_4C$, $(C_{11}H_{23}SCH_2CH_2COOCH_2)_4C$, $(C_{12}H_{25}SCH_2CH_2COOCH_2)_4C$, $(C_{13}H_{27}SCH_2CH_2COOCH_2)_4C$, $(C_{14}H_{29}SCH_2CH_2COOCH_2)_4C$, $(C_{15}H_{31}SCH_2CH_2COOCH_2)_4C$, $(C_{16}H_{33}SCH_2CH_2COOCH_2)_4C$, $(C_{17}H_{35}SCH_2CH_2COOCH_2)_4C$, $(C_{18}H_{37}SCH_2CH_2COOCH_2)_4C$, $(C_{19}H_{39}SCH_2CH_2COOCH_2)_4C$, $(C_{20}H_{41}ScH_2CH_2COOCH_2)_4C$ and mixtures thereof. $(C_{12}H_{25}SCH_2CH_2COOCH_2)_4C$ is preferred.

The component (b-2), i.e. phosphites encompasses a compound represented by the formula $$(R^{17}O)_m\text{—p—}(OR^{18})_{3-m} \qquad \text{X}$$

wherein $R^{17}$ is a straight or branched alkyl group of 4–20 carbon atoms, $R^{18}$ is a phenyl group or alkylphenyl group having an alkyl group of 1–20 carbon atoms and m is an integer of 0–3.

Specific $R^{17}$ examples are n-butyl, isobutyl group, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl and straight or branched eicosyl of which particularily preferred are octyl group such as 2-ethylhexyl and decyl groups.

Specific $R^{18}$ examples are phenyl,.methylphenyl, dimethylphenyl, ethylphenyl, diethylphenyl, n-propylphenyl, di-n-propylphenyl, isopropylphenyl, diisopropylphenyl, n-butylphenyl, di-n-butylphenyl, isobutylphenyl, diisobutylphenyl, sec-butylphenyl, di-sec-butylphenyl, tert-butylphenyl, di-tert-butylphenyl, (straight or branched pentyl)phenyl, di(straight or branched pentyl) phenyl, (straight or branched hexyl)phenyl, di(straight or branched hexyl)phenyl, (straight or branched heptyl)phenyl, di(straight or branched heptyl)phenyl, (straight or branched octyl)phenyl, di(straight or branched octyl)phenyl, (straight or branched nonyl)phenyl, di(straight or branched nonyl) phenyl, (straight or branched decyl)phenyl, di(straight or branched decyl)phenyl, (straight or branched undecyl) phenyl, di(straight or branched undecyl)phenyl, (straight or branched dodecyl)phenyl, di(straight or branched dodecyl) phenyl, (straight or branched tridecyl)phenyl, di(straight or branched tridecyl)phenyl, (straight or branched tetradecyl) phenyl, di(straight or branched tetradecyl)phenyl, (straight or branched pentadecyl)phenyl and di(straight or branched pentadecyl)phenyl. More preffered are (straight or branched hexadecyl)phenyl, di(straight or branched hexadecyl) phenyl, (straight or branched heptadecyl)phenyl, di(straight or branched heptadecyl)phenyl, (straight or branched octadecyl)phenyl, di(straight or branched octadecyl)phenyl, (straight or branched nonadecyl)phenyl, di(straight or branched nonadecyl)phenyl, (straight or branched eicosyl) phenyl and di(straight or branched eicosyl)phenyl. Particularly preffered are phenyl, (straight or branched nonyl) phenyl and (straight or branched nonyl)phenyl.

Specific examples of the phosphites of the formula (X) are nonylphenyl-bis(dinonylphenyl)phosphite, tris (nonylphenyl)phosphite, 2-ethylhexyl-diphenylphosphite, decyl-diphenylphosphite, tridecylphosphite, triphenylphosphite and mixtures thereof.

The component (b-2) also emcompasses a compound represented by the formula $$\{(R^{19}O)_2P(OPh)\}_2C(CH_3)_2 \qquad \text{XI}$$

wherein $R^{19}$ is a straight or branched alkyl group of 12–15 carbon atoms and Ph is phenyl group. Specific examples of alkyl group $R^{19}$ include straight or branched dodecyl group, straight or branched tridecyl group, straight or branched tetradecyl group and straight or branched pentadecyl group.

Specific examples of the phosphites of the formula XI include $((C_{12}H_{25}O)_2P(OPh))_2C(CH_3)_2$, $((C_{13}H_{27}O)_2P(OPh))_2C(CH_3)_2$, $((C_{14}H_{29}O)_2P(OPh))_2C(CH_3)_2$, $((C_{15}H_{31}O)_2P(OPh))_2C(CH_3)_2$ and mixtures thereof.

The component (b-3), i.e. dithiophosphates encompasses zinc dihydrocarbyldithiophosphate represented by the formula

XII

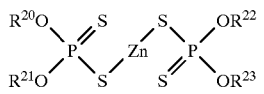

wherein $R^{20}$, $R^{21}$, $R^{22}$ and $R^{23}$ may be the same or different and each are a straight or branched alkyl group of 2–18, preferably 3–8 carbon atoms or an aryl group of 6–24 carbon atoms.

Exemplified as the groups $R^{20}$, $R^{21}$, $R^{22}$ and $R^{23}$ are an alkyl group such as ethyl, n-propyl, isopropyl, n-butyl, isobutyl, sec-butyl,tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl; and an aryl group such as phenyl, ethylphenyl, propylphenyl, isopropylphenyl, butylphenyl, pentylphenyl, hexylphenyl, heptylphenyl, octylphenyl, 2-ethylhexylphenyl, nonylphenyl, decylphenyl, undecylphenyl, dodecylphenyl, tridecylphenyl, tetradecylphenyl, pentadecylphenyl, hexadecylphenyl, heptadecylphenyl and octadecylphenyl.

Specific compounds of formula XII exemplarily include zinc diethyldithiophosphate, zinc di-n-propyldithiophosphate, zinc diisopropyldithiophosphate, zinc di-n-butyldithiophosphate, zinc diisobutyldithiophosphate, zinc di-sec-butyldithiophosphate, zinc di-tert-butyldithiophosphate, zinc di(straight or branched pentyl)dithiophosphate, zinc di(straight or branched hexyl)dithiophosphate, zinc di(straight or branched heptyl)dithiophosphate, zinc di(straight or branched octyl)dithiophosphate, zinc di(straight or branched nonyl)dithiophosphate, zinc di(straight or branched decyl)dithiophosphate, zinc di(straight or branched undecyl)dithiophosphate, zinc di(straight or branched dodecyl)dithiophosphate, zinc di(straight or branched tridecyl)dithiophosphate, zinc di(straight or branched tetradecyl)dithiophosphate, zinc di(straight or branched pentadecyl)dithiophosphate, zinc di(straight or branched hexadecyl)dithiophosphate, zinc di(straight or branched octadecyl)dithiophosphate, zinc diphenyldithiophosphate, zinc diethylphenyldithiophosphate, zinc dipropylphenyldithiophosphate, zinc diisopropylphenyldithiophosphate, zinc dibutylphenyldithiophosphate, zinc dipentylphenyldithiophosphate, zinc dihexylphenyldithiophosphate, zinc diheptylphenyldithiophosphate, zinc dioctylphenyldithiophosphate, zinc di-2-ethylhexylphenyldithiophosphate, zinc dinonylphenyldithiophosphate, zinc didecylphenyldithiophosphate, zinc diundecylphenyldithiophosphate, zinc didodecylphenyldithiophosphate, zinc ditridecylphenyldithiophosphate, zinc ditetradecylphenyldithiophosphate, zinc dipentadecylphenyldithiophosphate, zinc dihexadecylphenyldithiophosphate, zinc diheptadecylphenyldithiophosphate, zinc dioctadecylphenyldithiophosphate and mixtures thereof.

The component (b-3) also encompasses dihydrocarbyldithiophosphate represented by the formula

XIII

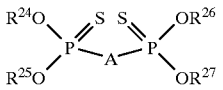

wherein $R^{24}$, $R^{25}$, $R^{26}$ and $R^{27}$ may be the same or different and each are a straight or branched alkyl group of 2–18, preferably 3–8 or an aryl group of 6–24 and A is S, S—S or S—$CH_2$—S.

The groups $R^{24}$, $R^{25}$, $R^{26}$ and $R^{27}$ exemplarily include an alkyl group such as ethyl, n-propyl, isopropyl, n-butyl, isobutyl, sec-butyl,tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl; and an aryl group such as phenyl, ethylphenyl, propylphenyl, isopropylphenyl, butylphenyl, pentylphenyl, hexylphenyl, heptylphenyl, octylphenyl, 2-ethylhexylphenyl, nonylphenyl, decylphenyl, undecylphenyl, dodecylphenyl, tridecylphenyl, tetradecylphenyl, pentadecylphenyl, hexadecylphenyl, heptadecylphenyl and octadecylphenyl.

The component (b-4), i.e. dithiocarbamates encompasses zinc dihydrocarbyldithiocarbamate represented by the formula

XIV

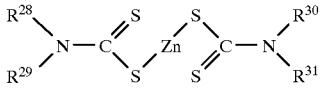

wherein $R^{28}$, $R^{29}$, $R^{30}$ and $R^{31}$ may be the same or different and each are a straight or branched alkyl group of 2–18, preferably 3–8 carbon atoms or an aryl group of 6–24 carbon atoms.

The groups $R^{28}$, $R^{29}$, $R^{30}$ and $R^{31}$ exemplarily include an alkyl group such as ethyl, n-propyl, isopropyl, n-butyl, isobutyl, sec-butyl,tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl; and an aryl group such as phenyl, ethylphenyl, propylphenyl, isopropylphenyl, butylphenyl, pentylphenyl, hexylphenyl, heptylphenyl, octylphenyl, 2-ethylhexylphenyl, nonylphenyl, decylphenyl, undecylphenyl, dodecylphenyl, tridecylphenyl, tetradecylphenyl, pentadecylphenyl, hexadecylphenyl, heptadecylphenyl and octadecylphenyl.

Specific examples of the compound of formula XIV are zinc diethyldithiocarbamate, zinc di-n-propyldithiocarbamate, zinc diisopropyldithiocarbamate, zinc di-n-butyldithiocarbamate, zinc diisobutyldithiocarbamate, zinc di-sec-butyldithiocarbamate, zinc di-tert-butyldithiocarbamate, zinc di(straight or branched pentyl)dithiocarbamate, zinc di(straight or branched hexyl)dithiocarbamate, zinc di(straight or branched heptyl)dithiocarbamate, zinc di(straight or branched octyl)dithiocarbamate, zinc di(straight or branched nonyl)dithiocarbamate, zinc di(straight or branched decyl)dithiocarbamate, zinc di(straight or branched undecyl)dithiocarbamate, zinc di(straight or branched dodecyl)dithiocarbamate, zinc di(straight or branched tridecyl)dithiocarbamate, zinc di(straight or branched tetradecyl)dithiocarbamate, zinc di(straight or branched pentadecyl)dithiocarbamate, zinc di(straight or branched hexadecyl)dithiocarbamate, zinc di(straight or branched heptadecyl)dithiocarbamate, zinc di(straight or branched octadecyl)dithiocarbamate, zinc diphenyldithiocarbamate, zinc diethylphenyldithiocarbamate, zinc dipropylphenyldithiocarbamate, zinc diisopropylphenyldithiocarbamate, zinc dibutylphenyldithiocarbamate, zinc dipentylphenyldithiocarbamate, zinc dihexylphenyldithiocarbamate, zinc diheptylphenyldithiocarbamate, zinc dioctylphenyldithiocarbamate, zinc di-2-ethylhexylphenyldithiocarbamate, zinc dinonylphenyldithiocarbamate, zinc didecylphenyldithiocarbamate, zinc diundecylphenyldithiocarbamate, zinc didodecylphenyldithiocarbamate, zinc ditridecylphenyldithiocarbamate, zinc ditetradecylphenyldithiocarbamate, zinc dipentadecylphenyldithiocarbamate, zinc dihexadecylphenyldithiocarbamate, zinc diheptadecylphenyldithiocarbamate, zinc dioctadecylphenyldithiocarbamate and mixtures thereof.

The component (b-4) also encompasses the hidrocarbyldithiocarbamate represented by the formula

XV

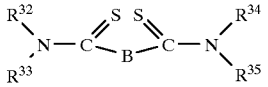

wherein $R^{32}$, $R^{33}$, $R^{34}$ and $R^{35}$ may be the same or different and each are a straight or branched alkyl group of 2–18, preferably 3–8 carbon atoms or an aryl group of 6–24 carbon atoms, B is S, S—S or S—$CH_2$—S.

The groups $R^{32}$, $R^{33}$, $R^{34}$ and $R^{35}$ exemplarily include an alkyl group such as ethyl, n-propyl, isopropyl, n-butyl, isobutyl, sec-butyl,tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl; and an aryl group such as phenyl, ethylphenyl, propylphenyl, isopropylphenyl, butylphenyl, pentylphenyl, hexylphenyl, heptylphenyl, octylphenyl, 2-ethylhexylphenyl, nonylphenyl, decylphenyl, undecylphenyl, dodecylphenyl, tridecylphenyl, tetradecylphenyl, pentadecylphenyl, hexadecylphenyl, heptadecylphenyl and octadecylphenyl.

The content of the sulfur and/or phosphorus-containing compound (b) in the inventive lubricant composition is in the range of between 0.1, preferably 0.2 and 5.0, preferably 2.0 percent by mass. Contents less than the lower limit of the specified range would not be so much effective and if in excess of the upper limit would lead to economically infeasible usage.

The component (c) according to the invention is one or more of the phenolic compounds selected from the group consisting of a compound (c-1) represented by the formula

XVI

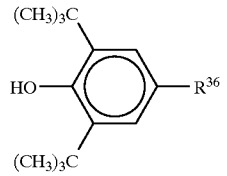

wherein $R^{36}$ is an alkyl group of 1–6 carbon atoms, a group of the formula (i)

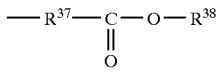

wherein $R^{37}$ is an alkylene group of 1–6 carbon atoms and $R^{38}$ is an alkyl group or alkylene group of 1–24 carbon atoms, or a group of the formula (ii)

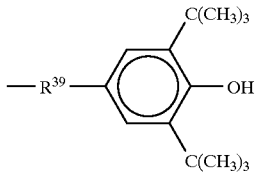

wherein $R^{39}$ is an alkylene group of 1–6 carbon atoms;

and a compound (c-2) represented by the formula

XVII

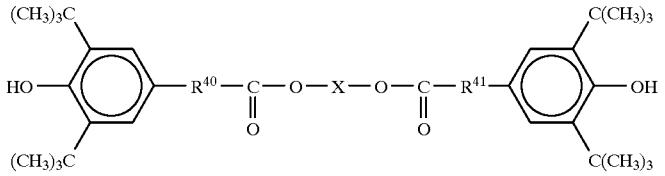

wherein $R^{40}$ and $R^{41}$ each are an alkylene group of 1–6 carbon atoms and X is an alkylene group of 1–18 carbon atoms or a group of the formula $$—R^{42}—S—R^{43}— \quad \text{(iii)}$$

wherein $R^{42}$ and $R^{43}$ each are an alkylene group of 1–6 carbon atoms.

The $C_1$–$C_4$ alkyl group $R^{36}$ in formula (XVI) exemplarily includes methyl, ethyl, n-propyl, isopropyl, n-butyl, isobutyl and sec-butyl groups. Preferred groups are methyl and ethyl groups.

In the case where the group $R^{36}$ of formula (XVI) is an alkyl group of 1–4 carbon atoms, preferred phenolic compounds are 2,6-di-tert-butyl-p-cresol, 2,6-di-tert-butyl-4-ethylphenol and mixtures thereof.

In the case where $R^{36}$ is the group of the formula (i), the $C_1$–$C_6$ alkylene group $R^{37}$ may be of straight or branched, exemplarily including the alkylene groups exemplified for $R^1$ of the formula (I). To obtain the compound of formula (XVI) with ease, more preferred are $C_1$–$C_2$ alkylene groups such as methylene, methylethylene and ethylene (dimethylene) groups.

$R^{38}$ in the formula (i) is a $C_1$–$C_{24}$ alkyl group or alkenyl group both of which may be of straight or branched. Specific examples of the group $R^{38}$ are the alkyl groups or alkenyl groups as exemplified for $R^2$. From the viewpoint of compatibility of the compound of formula (XVI) with the base oil (A), $R^{38}$ is preferably a $C_4$–$C_{18}$ alkyl group (straight or branched, whichever may be the case) which specifically includes n-butyl, isobutyl, sec-butyl, tert-butyl, pentyl, hexyl, heptyl, octyl, nonyl, decyl, undecyl, dodecyl, tridecyl, tetradecyl, pentadecyl, hexadecyl, heptadecyl and octadecyl, of which $C_6$–$C_{12}$ alkyl groups are preferred and those of branched chain are particularly preferred.

In the case where $R^{36}$ is the group of formula (i), preferably $R^{37}$ is a $C_1$–$C_2$ alkylen group and $R^{38}$ is a straight or branched $C_6$–$C_{12}$ alkyl group and more preferably $R^{37}$ is a $C_1$–$C_2$ alkylene group and R38 is a branched $C_6$–$C_{12}$ alkyl group.

Specific examples of the above preferred compounds (c-1) are n-hexyl (3,5-di-tert-butyl-4-hydroxyphenyl) acetate, isohexyl (3,5-di-tert-butyl-4-hydroxyphenyl) acetate, n-heptyl (3,5-di-tert-butyl-4-hydroxyphenyl) acetate, isoheptyl (3,5-di-tert-butyl-4-hydroxyphenyl) acetate, n-octyl (3,5-di-tert-butyl-4-hydroxyphenyl)acetate, isooctyl (3,5-di-tert-butyl-4-hydroxyphenyl)acetate, 2-ethylhexyl (3,5-di-tert-butyl-4-hydroxyphenyl)acetate, n-nonyl (3,5-di-tert-butyl-4-hydroxyphenyl)acetate, isononyl (3,5-di-tert-butyl-4-hydroxyphenyl)acetate, n-decyl (3,5-di-tert-butyl-4-hydroxyphenyl)acetate, isodecyl (3,5-di-tert-butyl-4-hydroxyphenyl)acetate, n-undecyl (3,5-di-tert-butyl-4-hydroxyphenyl)acetate, isoundecyl (3,5-di-tert-butyl-4-hydroxyphenyl)acetate, n-dodecyl (3,5-di-tert-butyl-4-hydroxyphenyl)acetate, isododecyl (3,5-di-tert-butyl-4-hydroxyphenyl)acetate, n-hexyl (3,5-di-tert-butyl-4-hydroxyphenyl)propionate, isohexyl (3,5-di-tert-butyl-4-hydroxyphenyl)propionate, n-heptyl (3,5-di-tert-butyl-4-hydroxyphenyl)propionate, isoheptyl (3,5-di-tert-butyl-4-hydroxyphenyl)propionate, n-octyl (3,5-di-tert-butyl-4-hydroxyphenyl)propionate, isooctyl (3,5-di-tert-butyl-4-hydroxyphenyl)propionate, 2-ethylhexyl (3,5-di-tert-butyl-4-hydroxyphenyl)propionate, n-nonyl (3,5-di-tert-butyl-4-hydroxyphenyl)propionate, isononyl (3,5-di-tert-butyl-4-hydroxyphenyl)propionate, n-decyl (3,5-di-tert-butyl-4-hydroxyphenyl)propionate, isodecyl (3,5-di-tert-butyl-4-hydroxyphenyl)propionate, n-undecyl (3,5-di-tert-butyl-4-hydroxyphenyl)propionate, isoundecyl (3,5-di-tert-butyl-4-hydroxyphenyl)propionate, n-dodecyl (3,5-di-tert-butyl-4-hydroxyphenyl)propionate, isododecyl (3,5-di-tert-butyl-4-hydroxyphenyl)propionate and mixtures thereof.

In the case where $R^{36}$ is the group of formula (ii), $R^{39}$ is a $C_1$–$C_6$ alkylene group which may be of straight or branched including alkylene groups as exemplified for $R^1$. With ease of commercial accessibility in view and also for less reaction complexity, the group $R^{39}$ is preferably a $C_1$–$C_3$ alkylene group such as methylene, methylmethylene, ethylene (dimethylene), ethylmethylene, propylene (methylethylene) and trimethylene.

Preferred compounds (c-1) of formula (XVI) where $R^{39}$ is the group of formula (ii) are bis(3,5-di-tert-butyl-4-hydroxyphenyl)methane, 1,1-bis(3,5-di-tert-butyl-4-hydroxyphenyl)ethane, 1,2-bis(3,5-di-tert-butyl-4-hydroxyphenyl)ethane, 1,1-bis(3,5-di-tert-butyl-4-hydroxyphenyl)propane, 1,2-bis(3,5-di-tert-butyl-4-hydroxyphenyl)propane, 1,3-bis(3,5-di-tert-butyl-4-hydroxyphenyl)propane, 2,2-bis(3,5-di-tert-butyl-4-hydroxyphenyl)propane and mixtures threrof.

The groups $R^{40}$ and $R^{41}$ in formula (XVII) are a $C_1$–$C_6$ alkylene group which may be of straight or branched chain, including independently the alkylene groups as exemplified for $R^1$. From the viewpoint of availability of the compound of formula (XVII) with least reaction complication and ease of commercial accessibility, the groups $R^{40}$ and $R^{41}$ are preferably $C_1$–$C_2$ alkylen groups such as methylene, methylmethylene and ethylene (dimethylene).

The group X is a $C_1$–$C_{18}$ alkylene group such as methylene, methylmethylene, ethylene (dimethylene), ehtylmethylene, propylene (methylethylene), trimethylene, straight or branched butylene, straight or branched pentylene, straight or branched hexylene, straight or branched heptylene, straight or branched octylen, straight or branched nonylene, straight or branched decylene, straight or branched undecylene, straight or branched dodecylene, straight or branched tridecylene, straight or branched tetradecylene, straight or branched pentadecylene, straight or branched hexadecylene, straight or branched heptadecylene and straight or branched octadecylene. Particularly preferred are $C_1$–$C_6$ alkylene groups such as methylene, methylmethylene, ethylene (dimethylene), ethylmethylene, propylene (methylethylene), trimethylene, straight or branched butylene, straight or branched pentylene and straight or branched hexylene that may be easily available. More preferred are $C_2$–$C_6$ straight alkylene groups such as ethylene (dimethylene), trimethylene, straight butylene (tetramethylene, straight pentylene, pentamethylene), straight hexylene (hexamethylene).

Preferred phenolic compounds (c-2) of formula (XVII) where the group X is a C1–C18 alkylene group are represented by the formula

XVIII

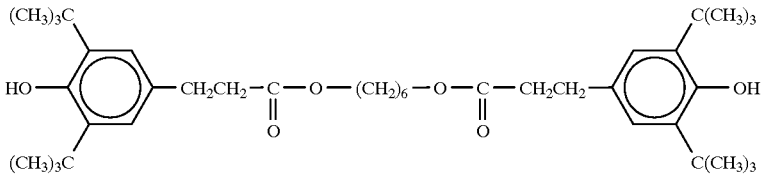

In the case where the group X is the group of formula (iii), $R^{42}$ and $R^{43}$ therein are a $C_1$–$C_6$ alkylene group which may be of straight or branched. Specific examples of $R^{42}$ and $R^{43}$ each are the alkylene groups as exemplified for $R^1$. More specifically, $R^{42}$ and $R^{43}$ each are preferably $C_1$–$C_3$ alkylene groups such as methylene, methylethylene (dimethylene), ethylmethylene, propylene (methylethylene) and trimethylene that may be easily accessible.

In the case where X is the group of formula (iii), preferred phenolic compounds can be represented by the formula

XIX

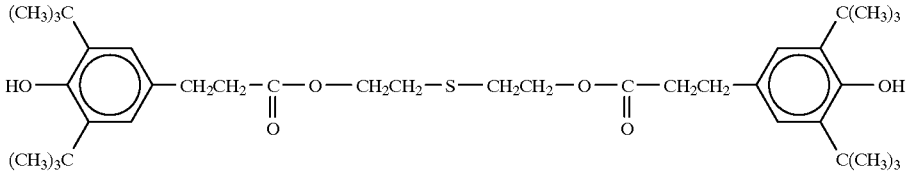

Needless to mention, the component (c) may be a single compound of formula (XVI) or (XVII). There may be also used mixtures of two or more of the compounds of formula (XVI) or (XVII) or of one or more of the compounds of formula (XVI) and one or more of the compound of formula (XVII) in suitable blend ratios.

The content of the component (c) in the inventive lubricant composition is in the range of between 0.1, preferably 0.2 and 5.0, preferably 2.0 percent by mass. Contents less than the lower limit of the specified range would result in reduced oxidative-stability and if in excess of the upper limit would not give so much rise to oxidative-stability, merely leading to economically infeasible usage.

For the purpose of providing enhanced oxidative-stability and improved sludge prevention, the inventive lubricating oil composition may be blended with one or more suitable additives including antioxidants such as of amines, sulfurs, zinc dithiophosphates and phenothiazines; rust inhibitors such as alkenyl succinic acid, alkenyl succinic acid ester, polyhydric alcohol ester, petroleum sulfonic acid and dinonylnaphthalenesulfonate; wear inhibitors and extreme pressure additives such as phosphoric ester, sulfurized fat and oil, sulfide and zinc dithiophosphate; wear-reducing agents such as aliphatic alcohol, fatty acid, aliphatic amine, aliphatic amine salt and fatty acid amide; metallic detergents such as alkaline-earth metal sulfonate, alkaline-earth metal phenolate, alkaline-earth metal salicylate and alkaline-earth metal phosphate; non-ash dispersants such as alkenyl succinimide, alkenyl succinate and benzylamine; antifoaming agents such as methylsilicone and fluorosilicone; and viscosity index improvers or pour point depressants such as polymethacrylate, polyiosbutylene, olefin copolymer and polystyrene.

Defoaming agents may be added in an amount of 0.0005–1 weight percent; viscosity index improvers in an amount of 1–30 weight percent; metallic inactivators in an amount of 0.005–1 weight percent; and other additives in an amount of 0.1–15 weight percent, all based on total composition.

The lubricating oil compositions of the invention find extensive use as for turbine oil, gasoline engine oil, diesel engine oil, automobile and industrial gear oils (automatic and manual transmission and differential oils), hydraulic machine oil, refrigerator oil, cutter oil, plastics processing oil (rolling, press, forging, squeezing, draw, punch and like oils), thermal treatment oil, discharge processing oil, slide guide oil, rust-proofing oil, heat medium oil and so on.

The invention will be further described by way of the following examples which are provided for purposes of illustration but will not impose limitation upon the invention.

Various lubricating oil compositions listed as Inventive Examples 1–37 and Comparative Examples 1–10 in Tables 1–5 were prepared from the following formulations.

Base oil (A): Solvent-refined paraffinic mineral oil (kinematic viscosity at 40° C. 32 $mm^2/s$, aromatics content 25 weight %)

(B): Hydrocracked paraffinic mineral oil (kinematic viscosity at 40° C. 32 $mm^2/s$, aromatics content 5 weight %)

(C): Hydrogenated 1-decene oligomer (number-average molecular weight 480, kinematic viscosity at 40° C. 31 $mm^2/s$)

3-methyl-5-tert-butyl-4-hydroxyphenyl-substituted Fatty Acid Ester (D): 3-methyl-5-tert-butyl-4-hydroxy propionic acid ester of the formula

XX

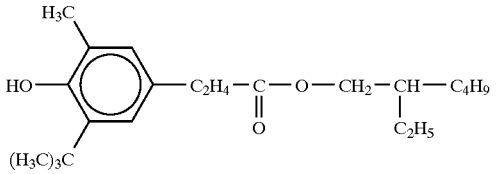

(E): 3-methyl-5-tert-butyl-4-hydroxy acetic acid ester of the formula

XXI

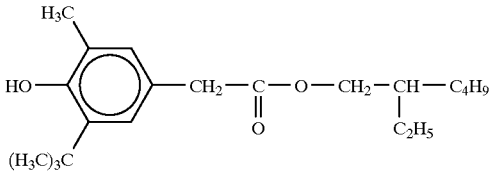

Nitrogen-containing Compound (F): 2-octyldithio-5-mercapto-1,3,4-thiadiazole
(G): benzotriazole
(H): dioctylaminomethylbenzotriazole
(I): dioctylaminomethyltolyltriazole
(J): 2-octyldithio-benzothiazole Sulfur and/or Phosphorus-containing Compound (K): dilaurylthiodipropionate
(L): diphenylphosphite
(M): zinc dioctyldithiophosphate
(N): zinc dipentyldithiocarbamate

XXIII

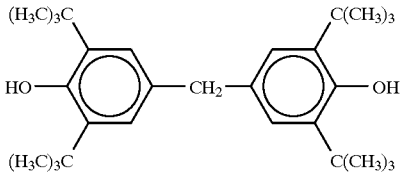

(Q): (3,5-di-tert-butyl-4-hydroxyphenyl)propionic acid ester of the formula

XXIV

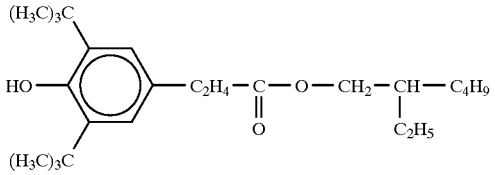

(R): a compound of the formula

XVIII

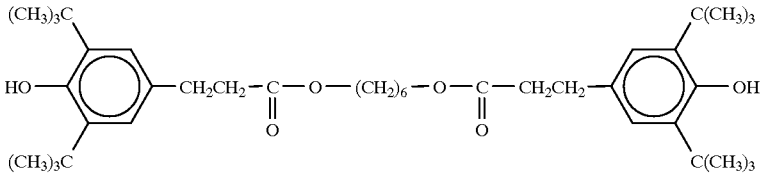

Phenolic Compound (O): 2,6-di-tert-butylphenol of the formula

XXII

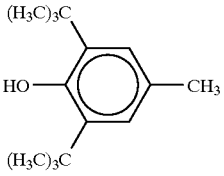

(P): bis(3,5-di-tert-butyl-4-hydroxypheny)methane of the formula (S): a compound of the formula

XIX

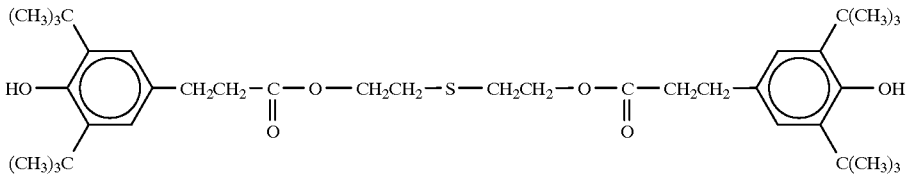

Each of the tabulated lubricant compositions was sampled for the following performance tests with the results shown in Tables below.

Oxidation Stability Test I

This test was conducted in accordance with JIS K2514 3.1. and carried out at a temperature of 150° C. The sample was checked for the length of time consumed for its total acid value to reach 2 mgKOH.

Oxidation Stability Test II

A rotary bomb oxidation test in accordance with JIS K2514 3.3 was conducted to measure the elapsed time up to the point at which the pressure drops to a terminal 175 kPa.

As indicated in Tables, the compositions of Inventive Examples 1–37 exhibited excellent oxidation stability as measured under the two different test conditions. It will be noted that the compositions of Inventive Examples 2 and 3 somewhat excel that of Inventive Example 1.

Whereas, the compositions of Comparative Examples 1, 2, and 5 through 10 in the absence of Component (B) were all inferior in oxidation stability to the inventive compositions. The compositions of Comparative Examples 3 and 4 in the absence of component (a) and/or (b) or (c) were superior in oxidation stability to Comparative Examples 1 and 2, but were still inferior to the inventive compositions.

TABLE 1

| | Inventive Examples | | | | | | | | |
|---|---|---|---|---|---|---|---|---|---|
| | 1 | 2 | 3 | 4 | 5 | 6 | 7 | 8 | 9 |
| Composition (mass %) | | | | | | | | | |
| Base Oil | A [98.95] | A [98.9] | B [98.95] | C [98.95] | B [98.95] | B [98.995] | B [98.95) | B [98.95] | B [98.95] |
| Component B | D [1.0] | D [1.0] | D [2.0] | D [1.0] | D [1.0] | D [1.0] | D [1.0] | D [1.0] | E [1.0] |
| Component (a) | I [0.05] | I [0.1] | I [0.05] | I [0.05] | F [0.05] | G [0.005] | H [0.05] | J [0.05] | [0.05] |
| Performance Test Results | | | | | | | | | |
| Oxidative Stability Test I (hour) | 216 | 240 | 312 | 336 | 336 | 312 | 336 | 312 | 360 |
| Oxidative Stability Test II (min.) | 323 | 349 | 812 | 856 | 883 | 786 | 824 | 793 | 895 |

TABLE 2

| | Inventive Examples | | | | | | | | | |
|---|---|---|---|---|---|---|---|---|---|---|
| | 10 | 11 | 12 | 13 | 14 | 15 | 16 | 17 | 18 | 19 |
| Composition (mass %) | | | | | | | | | | |
| Base Oil | A [98.6] | B [98.6] | A [97.6] | C [98.6] | B [98.6] | B [98.6] | B [98.6] | B [98.6] | B [98.6] | B [98.6] |
| Component B | D [1.0] | D [1.0] | D [2.0] | D [1.0] | D [1.0] | D [1.0] | D [1.0] | E [1.0] | E [1.0] | E [1.0] |
| Component (b) | K [0.4] | K [0.4] | K [0.4] | K [0.4] | L [0.4] | M [0.4] | N [0.4] | K [0.4] | L [0.4] | M [0.4] |
| Performance Test Results | | | | | | | | | | |
| Oxidative Stability Test I (hour) | 240 | 336 | 288 | 360 | 360 | 312 | 336 | 336 | 360 | 336 |
| Oxidative Stability Test II (min.) | 334 | 914 | 262 | 963 | 1066 | 436 | 492 | 932 | 1123 | 461 |

TABLE 3

| | Inventive Examples | | | | | | | | |
|---|---|---|---|---|---|---|---|---|---|
| | 20 | 21 | 22 | 23 | 24 | 25 | 26 | 27 | 28 |
| Composition (mass %) | | | | | | | | | |
| Base Oil | A [99.0] | B [99.0] | C [99.0] | B [99.0] | B [99.0] | B [99.0] | B [99.0] | B [99.0] | B [99.0] |
| Component B | D [0.5] | D [0.5] | D [0.5] | D [0.5] | D [0.5] | D [0.5] | D [0.5] | E [0.5] | E [0.5] |
| Component (c) | O [0.5] | O [0.5] | O [0.5] | P [0.5] | Q [0.5] | R [0.5] | S [0.5] | O [0.5] | Q [0.5] |
| Performance Test Results | | | | | | | | | |
| Oxidative Stability Test I (hour) | 192 | 288 | 312 | 312 | 312 | 336 | 384 | 288 | 312 |
| Oxidative Stability Test II (min.) | 288 | 538 | 572 | 362 | 446 | 504 | 693 | 562 | 458 |

TABLE 4

| | Inventive Examples | | | | | | | | |
|---|---|---|---|---|---|---|---|---|---|
| | 29 | 30 | 31 | 32 | 33 | 34 | 35 | 36 | 37 |
| Composition (mass %) | | | | | | | | | |
| Base Oil | A [98.55] | B [98.55] | C [98.55] | B [98.55] | B [98.55] | B [98.55] | B [98.55] | B [98.55] | B [98.55] |
| Component B | D [1.0] | D [1.0] | D [2.0] | D [1.0] | D [1.0] | D [1.0] | D [1.0] | D [1.0] | E [1.0] |
| Component (a) | I [0.05] | I [0.05] | I [0.05] | I [0.05] | I [0.05] | I [0.05] | I [0.05] | I [0.05] | I [0.05] |
| Component (b) | K [0.4] | K [0.4] | K [0.4] | L [0.4] | M [0.4] | N [0.4] | K (0.4] | L [0.4] | M [0.4] |
| Performance Test Results | | | | | | | | | |
| Oxidative Stability Test I (hour) | 288 | 384 | 408 | 384 | 336 | 360 | 408 | 384 | 360 |
| Oxidative Stability Test II (min.) | 381 | 928 | 1125 | 1142 | 463 | 528 | 1141 | 1207 | 485 |

TABLE 5

| | Comparative Examples | | | | | | | | | |
|---|---|---|---|---|---|---|---|---|---|---|
| | 1 | 2 | 3 | 4 | 5 | 6 | 7 | 8 | 9 | 10 |
| Composition (mass %) | | | | | | | | | | |
| Base Oil | A [99.95) | A [99.90] | A [99.0] | A [98.0] | A [99.6] | A [99.2] | A [99.0] | A [98.0] | A [99.55] | A [99.15] |
| Component B | — [1.0] | — [2.0] | D | D | — | — | — | — | — | — |
| Component (a) | I [0.05] | I [0.10] | — | — | — | — | — | — | I [0.05] | I [0.05] |
| Component (b) | — | — | — | — | K [0.4] | K [0.8] | — | — | K [0.4) | K [0.8] |
| Component (c) | — | — | — | — | — | — | O [1.0] | O [2.0] | — | — |
| Performance Test Results | | | | | | | | | | |
| Oxidative Stability Test I (hour) | 24 | 24 | 120 | 168 | - 72 | 96 | 144 | 188 | 72 | 120 |

TABLE 5-continued

| | Comparative Examples | | | | | | | | | |
|---|---|---|---|---|---|---|---|---|---|---|
| | 1 | 2 | 3 | 4 | 5 | 6 | 7 | 8 | 9 | 10 |
| Oxidative Stability Test II (min.) | 50 | 50 | 203 | 237 | 54 | 67 | 185 | 208 | 65 | 73 |

What is claimed is:

1. A lubricating oil composition which comprises:

(A) a base oil selected from mineral oils and synthetic oils, (B) 0.1 to 5 percent by mass, based on the total mass of the composition, of a 3-methyl-5-tert-butyl-4-hydroxyphenyl substituted fatty acid ester represented by the formula

I

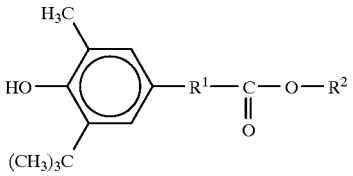

wherein $R^1$ is an alkylene group of 1–2 carbon atoms and $R^2$ is a branched alkyl group of 6–12 carbon atoms, and (C) 0.001 to 1 percent by mass, based on the total mass of the composition, of a nitrogen-containing compound selected from the group consisting of a thiadiazole represented by the formula

II

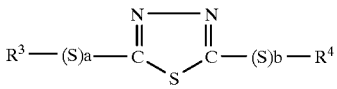

wherein $R^3$ is a $C_6$–$C_{24}$ alkyl group, $R^4$ is a $C_1$–$C_{24}$ alkyl group, a is an integer of 1–2 and b is integer of 1, a benzotriazole represented by the formula

IV

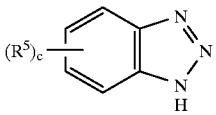

wherein $R^5$ is a straight or branched alkyl group of 1–4 carbon atoms and c is an integer of 1–3 and a benzothiazole represented by the formula

VI

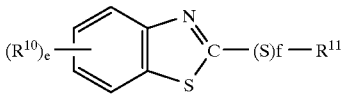

wherein $R^{10}$ is a methyl or ethyl group, $R^{11}$ is a straight or branched alkyl group of 6–24 carbon atoms, e is an integer of 0 or 1 and f is an integer of 1 or 2.

2. The lubricating oil composition according to claim 1 wherein the component (C) is a benzotriazole of the formula IV and wherein said $R^5$ is a methyl or ethyl group and said c is an integer of 1 or 2.

3. A lubricating oil composition according to claim 1 in which said base oil (A) is selected from the group consisting of (A-1) a mineral oil having a kinematic viscosity of 5–200 $mm^2/s$ at 40° C. and an aromatics content of less than 15 percent by mass (A-2) an olefinic polymer of 2–16 carbon atoms or its hydrogenated product having a number-average molecular weight of 250–4,000 and (A-3) an alkylbenzene having 1–4 alkyl groups of 1–40 carbon atoms and a total carbon number of said alkyl groups in the range of 6–40.

4. A lubricating oil composition according to claim 3 in which said kinematic viscosity of said mineral oil is in the range of 10–100 $mm^2/s$ at 40° C.

5. A lubricating oil composition according to claim 3 in which said aromatics content is smaller than 10 percent by mass.

6. A lubricating oil composition according to claim 3 in which said olefinic polymer has its double-bonds catalytically hydrogenated.

7. A lubricating oil composition according to claim 3 in which said number-average molecular weight is in the range of 350–1,500.

8. A lubricating oil composition according to claim 3 in which said olefinic polymer or its hydrogenated product has a kinematic viscosity of between 5 and 200 $mm^2/s$ at 40° C.

9. A lubricating oil composition according to claim 3 in which said alkylbenzene has 1–4 alkyl groups of 1–30 carbon atoms and a total carbon number of said alkyl groups in the range of 15–30.

10. A lubricating oil composition according to claim 3 in which said alkylbenzene has a kinematic viscosity of between 5 and 200 $mm^2/s$ at 40° C.

11. A lubricating oil composition which comprises:

(A) a base oil selected from mineral oils and synthetic oils, (B) 0.1 to 5 percent by mass, based on the total mass of the composition, of a 3-methyl-5-tert-butyl-4-hydroxyphenyl substituted fatty acid ester represented by the formula

I

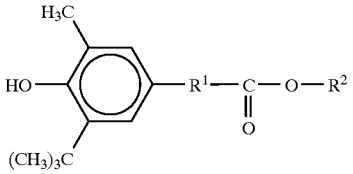

wherein $R^1$ is an alkylene group of 1–2 carbon atoms and $R^2$ is a branched alkyl group of 6–12 carbon atoms, and (C) 0.1 to 5.0 percent by mass, based on the total mass of the composition, of a sulfur- and/or phosphorus-containing compound selected from the group consisting of:

diesterpolysulfides and diestersulfides represented by the formula $$R^{14}OCO(CH_2)_hS_j(CH_2)_kCOOR^{15} \quad \text{VIII}$$

wherein $R^{14}$ and $R^{15}$ are the same or different and each are a straight or branched alkyl group of 4–20 carbon atoms, h and k are each 2 and j is an integer of −2, tetraestertetrasulfides represented by the formula $$(R^{16}SCH_2CH_2OOCH_2)_4C \quad \text{IX}$$

wherein $R^{16}$ is a straight or branched alkyl group of 12–13 carbon atoms, dihydrocarbyldithiophosphates represented by the formulae

XII

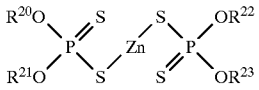

or]

XIII

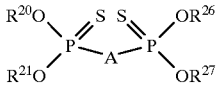

wherein $R^{24}$, $R^{25}$, $R^{26}$ and $R^{27}$ are each independently a straight or branched alkyl group of 3–8 carbon atoms or an aryl group of 6–24 carbon atoms and A is S, S—S or S—$CH_2$—S, and dihydrocarbyldithiocarbamates represented by the formulae

XIV

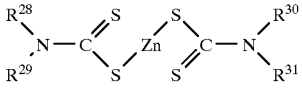

or]

XV

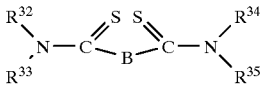

wherein $R^{32}$, $R^{33}$, $R^{34}$ and $R^{35}$ are each independently a straight or branched alkyl group of 3–8 carbon atoms or an aryl group of 6–24 carbon atoms and B is S, S—S or S—$CH_2$—S.

12. A lubricating oil composition according to claim 11 in which said base oil (A) is selected from the group consisting of (A-1) a mineral oil having a kinematic viscosity of 5–200 $mm^2/s$ at 40° C. and an aromatics content of less than 15 percent by mass, (A-2) an olefinic polymer of 2–16 carbon atoms or its hydrogenated product having a number-average molecular weight of 250–4,000 and (A-3) an alkylbenzene having 1–4 alkyl groups of 1–40 carbon atoms and a total carbon number of said alkyl groups in the range of 6–40.

13. A lubricating oil composition according to claim 12 in which said kinematic viscosity of said mineral oil is in the range of 10–100 $mm^2/s$ at 40° C.

14. A lubricating oil composition according to claim 12 in which said aromatics content is smaller than 10 percent by mass.

15. A lubricating oil composition according to claim 12 in which said olefinic polymer has its double-bonds catalytically hydrogenated.

16. A lubricating oil composition according to claim 12 in which said number-average molecular weight is in the range of 350–1,500.

17. A lubricating oil composition according to claim 12 in which said olefinic polymer or its hydrogenated product has a kinematic viscosity of between 5 and 200 $mm^2/s$ at 40° C.

18. A lubricating oil composition according to claim 12 in which said alkylbenzene has 1–4 alkyl groups of 1–30 carbon atoms and a total carbon number of said alkyl groups in the range of 15–30.

19. A lubricating oil composition according to claim 12 in which said alkylbenzene has a kinematic viscosity of between 5 and 200 $mm^2/s$ at 40° C.

* * * * *